US009037030B2

(12) United States Patent
Tsukada et al.

(10) Patent No.: US 9,037,030 B2
(45) Date of Patent: May 19, 2015

(54) POWER CONTROL SYSTEM AND POWER CONTROL METHOD

(71) Applicant: FUJI XEROX CO., LTD., Minato-ku, Tokyo (JP)

(72) Inventors: Shigeru Tsukada, Kanagawa (JP); Koji Ohashi, Kanagawa (JP); Hiroyuki Akanuma, Kanagawa (JP); Tomohisa Suzuki, Kanagawa (JP); Yoshiya Mashimo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 53 days.

(21) Appl. No.: 13/735,641

(22) Filed: Jan. 7, 2013

(65) Prior Publication Data

US 2013/0315614 A1 Nov. 28, 2013

(30) Foreign Application Priority Data

May 22, 2012 (JP) ..... 2012-116773

(51) Int. Cl.
*G03G 15/00* (2006.01)

(52) U.S. Cl.
CPC ..... *G03G 15/5004* (2013.01)

(58) Field of Classification Search
USPC ..... 399/37, 88
See application file for complete search history.

(56) References Cited

U.S. PATENT DOCUMENTS

| | | | | |
|---|---|---|---|---|
| 5,317,366 | A * | 5/1994 | Koshi et al. | 399/1 |
| 6,851,781 | B2 * | 2/2005 | Yokoyama | 347/14 |
| 8,320,788 | B2 * | 11/2012 | Saeki | 399/88 |
| 2003/0191975 | A1 * | 10/2003 | Kohara | 713/300 |
| 2008/0188993 | A1 * | 8/2008 | Ikusawa | 700/297 |
| 2009/0021766 | A1 * | 1/2009 | Yamazaki | 358/1.14 |
| 2012/0229831 | A1 * | 9/2012 | Kuroishi et al. | 358/1.13 |
| 2013/0094876 | A1 * | 4/2013 | Okunishi et al. | 399/88 |

FOREIGN PATENT DOCUMENTS

| | | | |
|---|---|---|---|
| JP | 10-026907 | A | 1/1998 |
| JP | 2003-303075 | A | 10/2003 |
| JP | 2010-218418 | A | 9/2010 |

* cited by examiner

*Primary Examiner* — Francis Gray
(74) *Attorney, Agent, or Firm* — Sughrue Mion, PLLC

(57) ABSTRACT

A power control system includes an image forming apparatus, a power calculating unit, and a condition controller. The image forming apparatus operates using power, forms an image corresponding to image information in a first operation mode, and enters a second operation mode in which power consumption is smaller than the first operation mode when the image forming apparatus satisfies a specific transition condition. The power calculating unit calculates power supplied from a power supplying unit. The condition controller controls the specific transition condition for the image forming apparatus in accordance with the power calculated by the power calculating unit.

14 Claims, 17 Drawing Sheets

FIG. 4

61

| TIME | FIRST UPPER LIMIT | SECOND UPPER LIMIT | LOWER LIMIT |
|---|---|---|---|
| 0 | 2 | 5 | 0 |
| 1 | 2 | 5 | 0 |
| 2 | 2 | 5 | 0 |
| 3 | 2 | 5 | 0 |
| 4 | 2 | 5 | 0 |
| 5 | 2 | 5 | 0 |
| 6 | 2 | 5 | 0 |
| 7 | 3 | 7 | 1.5 |
| 8 | 3 | 7 | 1.5 |
| 9 | 5 | 7 | 1.5 |
| 10 | 5 | 7 | 1.5 |
| 11 | 5 | 7 | 1.5 |
| 12 | 5 | 7 | 1.5 |
| 13 | 5 | 7 | 1.5 |
| 14 | 5 | 7 | 1.5 |
| 15 | 5 | 7 | 1.5 |
| 16 | 5 | 7 | 1.5 |
| 17 | 5 | 7 | 1.5 |
| 18 | 3 | 5 | 1.5 |
| 19 | 3 | 5 | 1.5 |
| 20 | 3 | 5 | 1.5 |
| 21 | 3 | 5 | 1.5 |
| 22 | 2 | 5 | 0 |
| 23 | 2 | 5 | 0 |
| 24 | 2 | 5 | 0 |

FIG. 9

64

| APPARATUS ID | COLOR | POWER CONSUMPTION | NUMBER OF CLIENTS | NUMBER OF PRINTED PAGES | PLACE | PRIORITY LEVEL |
|---|---|---|---|---|---|---|
| a | COLOR | 200 | 15 | 153 | 1F−1 | → 2 |
| b | COLOR | 300 | 25 | 384 | 2F−1 | → 1 |
| c | COLOR | 150 | 10 | 529 | 1F−2 | → 3 |
| d | COLOR | 150 | 12 | 102 | 2F−2 | → 6 |
| e | MONOCHROME | 120 | 5 | 87 | 2F−1 | → 7 |
| f | MONOCHROME | 150 | 7 | 324 | 1F−1 | → 4 |
| g | MONOCHROME | 150 | 3 | 118 | 2F−3 | → 5 |
| h | MONOCHROME | 120 | 5 | 55 | 2F−4 | → 8 |

FIG. 18

67

| PLACE | PRIORITY LEVEL |
|---|---|
| 1F-1 | 1 |
| 1F-2 | 3 |
| 2F-1 | 2 |
| 2F-3 | 4 |
| 2F-4 | 5 |

POWER CONTROL SYSTEM AND POWER CONTROL METHOD

CROSS-REFERENCE TO RELATED APPLICATIONS

This application is based on and claims priority under 35 USC 119 from Japanese Patent Application No. 2012-116773 filed May 22, 2012.

BACKGROUND (i) Technical Field

The present invention relates to a power control system and a power control method.

(ii) Related Art

Techniques for reducing power consumption in image forming apparatuses have been available.

SUMMARY

According to an aspect of the invention, there is provided a power control system including an image forming apparatus, a power calculating unit, and a condition controller. The image forming apparatus operates using power, forms an image corresponding to image information in a first operation mode, and enters a second operation mode in which power consumption is smaller than the first operation mode when the image forming apparatus satisfies a specific transition condition. The power calculating unit calculates power supplied from a power supplying unit. The condition controller controls the specific transition condition for the image forming apparatus in accordance with the power calculated by the power calculating unit.

BRIEF DESCRIPTION OF THE DRAWINGS

Exemplary embodiments of the present invention will be described in detail based on the following figures, wherein:

FIG. 4 is a diagram illustrating an example of target values of power consumption;

FIG. 9 is a diagram illustrating an example of an apparatus information database;

FIG. 18 is a diagram illustrating an example of the priority level of installation places according to a modification.

DETAILED DESCRIPTION

1. Configuration

Figure 1:
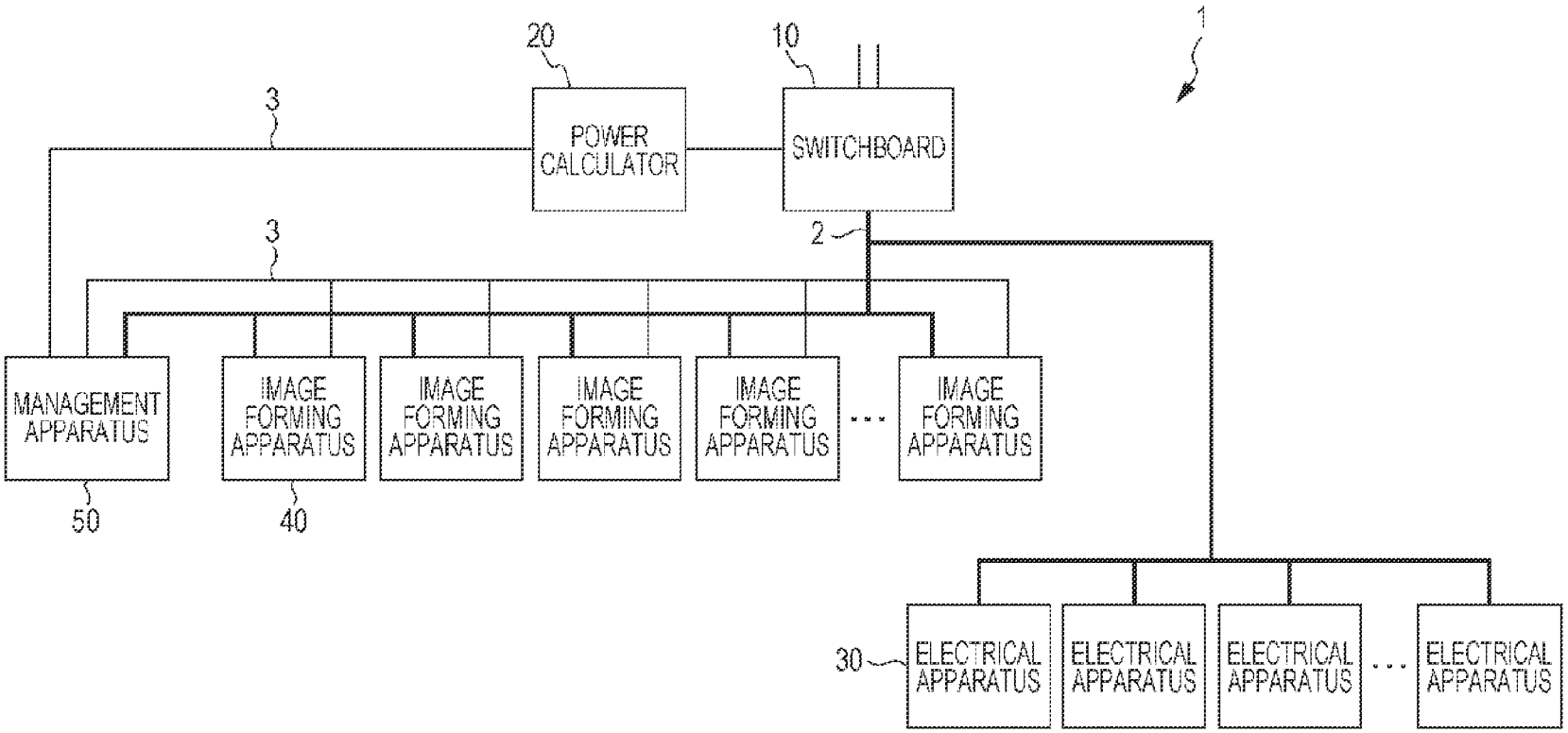
FIG. 1 is a diagram illustrating an example of a power control system.

FIG. 1 is a diagram illustrating an example of a power control system 1 according to an exemplary embodiment. The power control system 1 includes a switchboard 10, a power calculator 20, plural electrical apparatuses 30, plural image forming apparatuses 40, and a management apparatus 50. The switchboard 10, the plural electrical apparatuses 30, the plural image forming apparatuses 40, and the management apparatus 50 are connected to one another via a power supply line 2. The switchboard 10 and the power calculator 20 are connected to each another via a communication line 3, and the power calculator 20 and the management apparatus 50 are connected to each another via another communication line 3. The management apparatus 50 and the plural image forming apparatuses 40 are connected to one another via a still another communication line 3.

The switchboard 10 distributes externally supplied power to the electrical apparatuses 30, the image forming apparatuses 40, and the management apparatus 50. That is, the switchboard 10 is an example of a power supplying unit that supplies power to plural apparatuses including the image forming apparatuses 40. The switchboard 10 includes a breaker 11. The switchboard 10 is provided, for example, in each room, on each floor of a building, or in each building.

Figure 2:
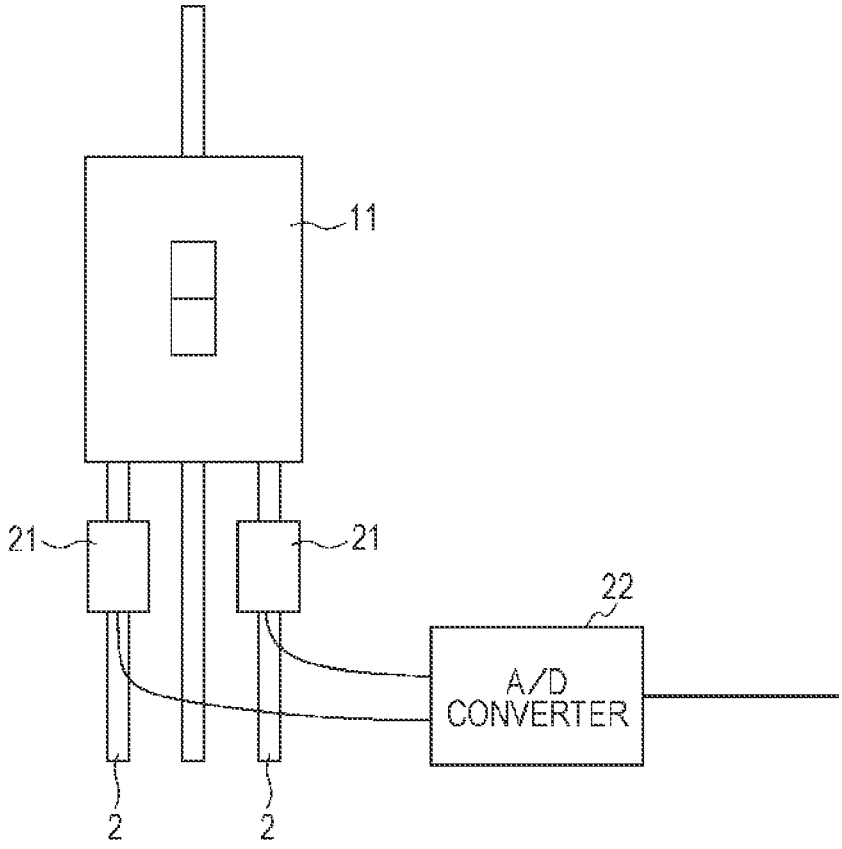
FIG. 2 is a diagram illustrating an example of a power calculator.

The power calculator 20 calculates current supplied from the switchboard 10 to the electrical apparatuses 30, the image forming apparatuses 40, and the management apparatus 50. In this exemplary embodiment, the power calculator 20 functions as a power calculating unit that calculates, in cooperation with a power computing unit 71, which will be described later, the power supplied from the switchboard 10 to plural apparatuses including the image forming apparatuses 40. FIG. 2 is a diagram illustrating an example of the power calculator 20. The power calculator 20 includes a current sensor 21 and an analog-to-digital (A/D) converter 22. The current sensor 21 is installed at the power supply line 2, which is connected to the breaker 11. The current sensor 21 outputs a signal corresponding to the current flowing in the power supply line 2. The signal output from the current sensor 21 is input to the A/D converter 22. The A/D converter 22 converts the input signal (analog signal) into a digital signal, and outputs a current value representing the magnitude of the current.

The electrical apparatuses 30 are apparatuses that operate using power supplied from the switchboard 10. The electrical apparatuses 30 are, for example, lighting apparatuses, air-conditioning apparatuses, electric pots, personal computers, and the like. The electrical apparatuses 30 are different from the image forming apparatuses 40.

The image forming apparatuses 40 form images corresponding to image information onto recording media, such as paper, in an electrophotographic method. Image information is input from, for example, a client apparatus, which is not illustrated, to the image forming apparatuses 40. The image forming apparatuses 40 operate using power supplied from the switchboard 10. The image forming apparatuses 40 have a normal operation mode (an example of a first operation mode) and an energy-saving mode (an example of a second operation mode). The energy-saving mode is an operation mode in which the amount of power consumption is smaller than the normal operation mode. During the energy-saving mode, an operation for forming an image is not performed. The energy-saving mode is realized, for example, by interrupting power supply to part of the configuration of the image forming apparatuses 40. Here, the part of the configuration is, for example, a fixing device that performs fixing processing. In the case where a specific transition condition is satisfied, the image forming apparatuses 40 enter the energy-saving mode. A transition condition that the image forming apparatuses 40 enter the energy-saving mode in the case where no operation is performed or no image data is input within a specific first transition period (for example, fifteen minutes) is set for the image forming apparatuses 40. Furthermore, in the case where a specific return condition is satisfied in the energy-saving mode, the image forming apparatuses 40 return to the normal operation mode. The return condition that the image forming apparatuses 40 return to the normal operation mode in the case where a specific operation is performed or image information is input in the energy-saving mode is set for the image forming apparatuses 40.

Figure 3:
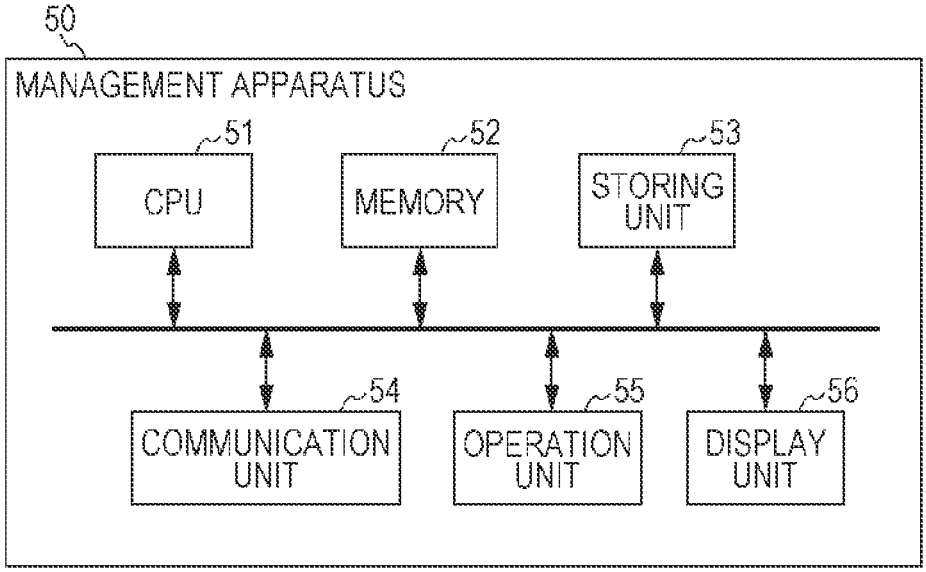
FIG. 3 is a diagram illustrating the configuration of a management apparatus.

The management apparatus 50 manages the power consumption of the entire power control system 1. FIG. 3 is a diagram illustrating the configuration of the management apparatus 50. The management apparatus 50 includes a central processing unit (CPU) 51, a memory 52, a storing unit 53, a communication unit 54, an operation unit 55, and a display unit 56. The CPU 51 performs various types of processing and control by executing a program stored in the memory 52. The memory 52 includes, for example, a read only memory (ROM) and a random access memory (RAM). A program to be executed by the CPU 51 is stored in the memory 52. The storing unit 53 includes, for example, a hard disk. Data to be used for processing is stored in the storing unit 53. The communication unit 54 is connected to the communication line 3, and performs data communication with the power calculator 20 or the image forming apparatuses 40 via the communication line 3. The management apparatus 50 and the power calculator 20 or the image forming apparatuses 40 may perform wired communication via the communication line 3 or may perform wireless communication. The operation unit 55 includes, for example, a keyboard and a mouse. The operation unit 55 receives input of an instruction and operation to the management apparatus 50. The display unit 56 includes, for example, a liquid crystal display. The display unit 56 displays operation images and various messages under the control of the CPU 51.

2. Operation

(1) Setting of Power Consumption Target

Figure 5:
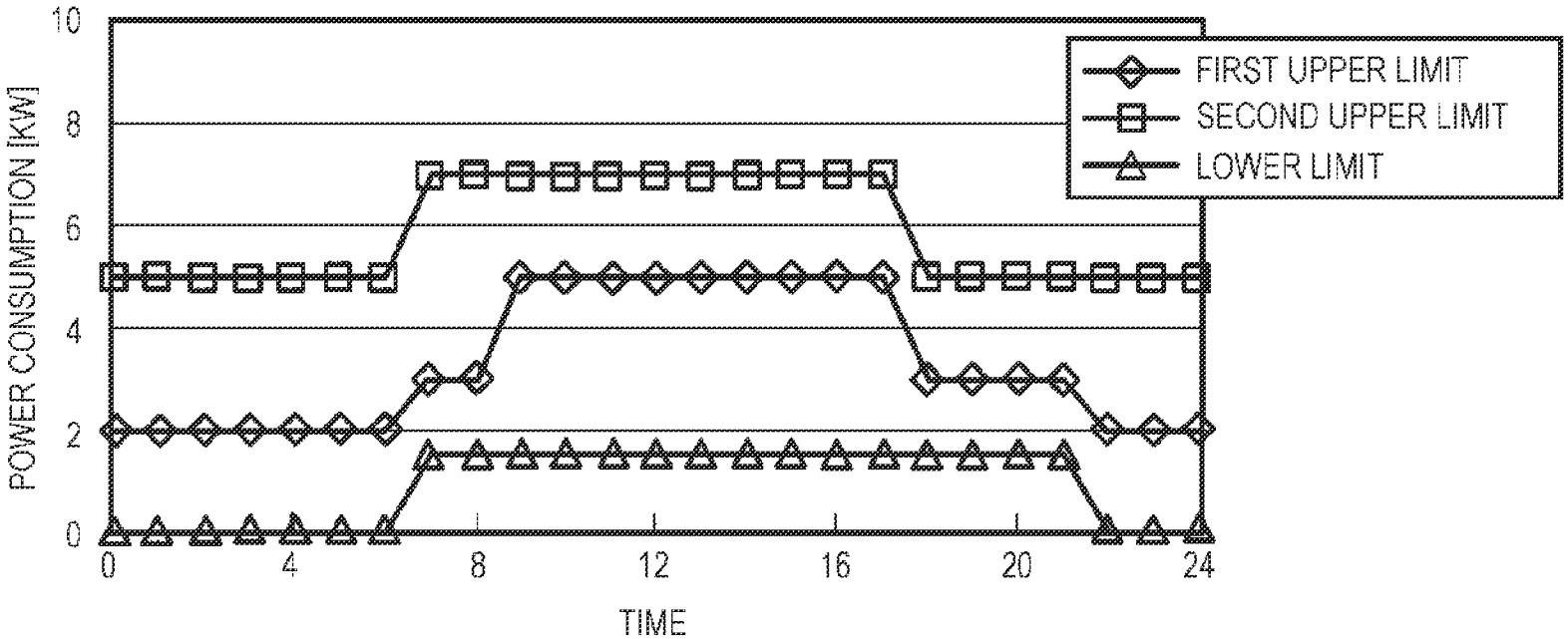
FIG. 5 is a diagram illustrating the target values illustrated in FIG. 4 in the form of a graph.

A user operates the management apparatus 50 using the operation unit 55 and sets a target value 61 of the power consumption of the entire power control system 1. FIG. 4 is a diagram illustrating an example of the target value 61 of power consumption. FIG. 5 is a diagram representing the target value 61 illustrated in FIG. 4 in the form of a graph. Specifically, the user sets, hourly between 00:00 and 24:00, a first upper limit (an example of a first threshold), a second upper limit (an example of a second threshold), and a lower limit (an example of a third threshold) of power consumption. Two levels, the first upper limit and the second upper limit, are set as the upper limit of power consumption. In the case where the power consumption exceeds the first upper limit, the power consumption should be gradually reduced. The second upper limit is greater than the first upper limit. In the case where the power consumption exceeds the second upper limit, the power consumption should be reduced so as to be below the second upper limit. The lower limit is smaller than the first upper limit. At the lower limit, there is extra power to be consumed. When the target value 61 of power consumption is set, the CPU 51 stores the set target value 61 into the storing unit 53.

Figure 6:
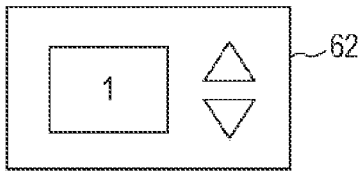
FIG. 6 is a diagram illustrating an example of a setting screen for a second transition period.

Furthermore, the user operates the management apparatus 50 using the operation unit 55 and sets a second transition period, which is used in the case where the transition period for the energy-saving mode is shortened. Here, the CPU 51 displays a setting screen 62 for the second transition period on the display unit 56 in accordance with an instruction from the user. FIG. 6 is a diagram illustrating an example of the setting screen 62 for the second transition period. For example, in the case where the first transition period is fifteen minutes, the user sets, on the setting screen 62, one minute, which is shorter than the first transition period, as the second transition period. When the second transition period for the energy-saving mode is set, the CPU 51 stores the set second transition period into the storing unit 53.

(2) Setting of Priority Determination Conditions

Figure 7:
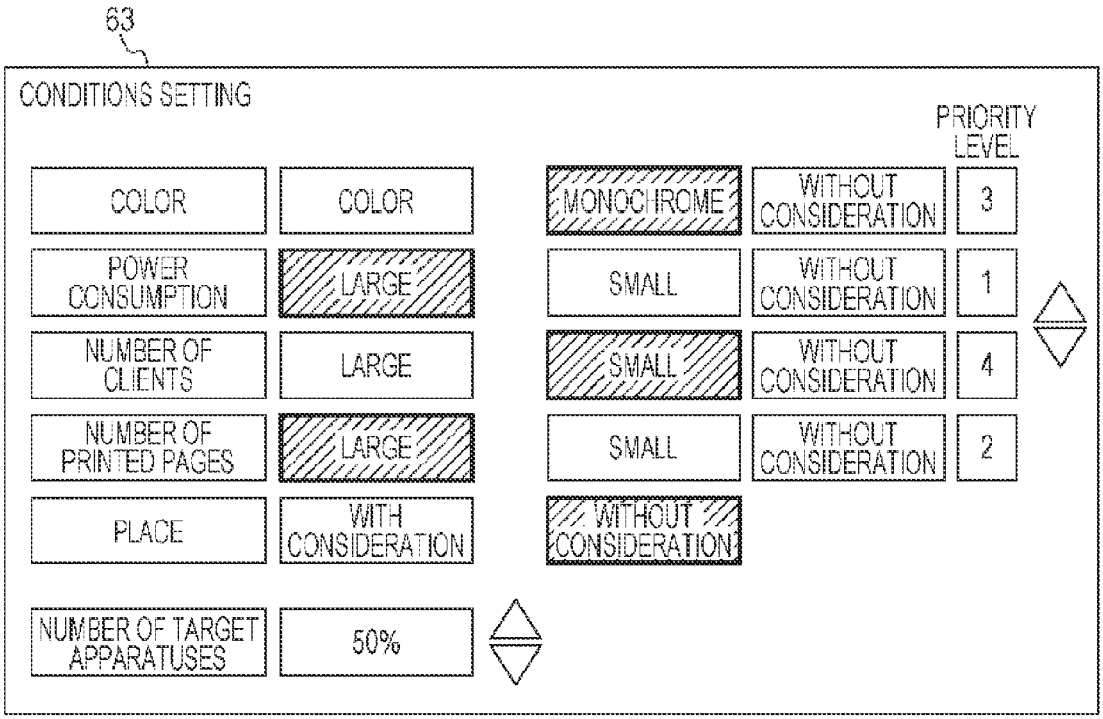
FIG. 7 is a diagram illustrating an example of a conditions setting screen.

The user operates the management apparatus 50 using the operation unit 55 and sets conditions for determining the priority for the image forming apparatuses 40. Here, the CPU 51 displays a conditions setting screen 63 on the display unit 56 in accordance with an instruction from the user. FIG. 7 is a diagram illustrating an example of the conditions setting screen 63. The conditions for determining priority includes "color", "power consumption", "the number of clients", "the number of printed pages", and "place".

For the condition regarding "color", "color" represents an image forming apparatus 40 that forms a color image, and "monochrome" represents an image forming apparatus 40 that forms a monochrome image. In order to cause the image forming apparatus 40 that forms a color image to preferentially enter the energy-saving mode, the user selects "color". Meanwhile, in order to cause the image forming apparatus 40 that forms a monochrome image to preferentially enter the energy-saving mode, the user selects "monochrome", as illustrated in FIG. 7. Furthermore, in the case where the user does not take into consideration of which one of the image forming apparatus 40 that forms a color image and the image forming apparatus 40 that forms a monochrome image is to be given priority, the user selects "without consideration".

For the condition regarding "power consumption", "large" represents that the power consumed by an image forming apparatus 40 is large, and "small" represents that the power consumed by an image forming apparatus 40 is small. In order to cause the image forming apparatus 40 that consumes larger power to preferentially enter the energy-saving mode, the user selects "large", as illustrated in FIG. 7. Meanwhile, in order to cause the image forming apparatus 40 that consumes smaller power to preferentially enter the energy-saving mode, the user selects "small". Furthermore, in the case where the user does not take into consideration the power consumption of the image forming apparatuses 40 in determining the priority, the user selects "without consideration".

For the condition regarding "the number of clients", "large" represents that a larger number of client apparatuses use an image forming apparatus 40, and "small" represents that a smaller number of client apparatuses use an image forming apparatus 40. In order to cause the image forming apparatus 40 that is used by a larger number of client apparatuses to preferentially enter the energy-saving mode, the user selects "large". Meanwhile, in order to cause the image forming apparatus 40 that is used by a smaller number of client apparatuses to preferentially enter the energy-saving mode, the user selects "small", as illustrated in FIG. 7. Furthermore, in the case where the user does not take into consideration the number of client apparatuses in determining the priority, the user selects "without consideration".

For the condition regarding "the number of printed pages", "large" represents that a larger number of pages were printed by an image forming apparatus 40 during a set period (for example, during last week), and "small" represents that a smaller number of pages were printed by an image forming apparatus 40 during the set period. The number of printed pages represents the number of pages of recording medium on which an image is formed by an image forming apparatus 40 and which is output from the image forming apparatus 40. In order to cause the image forming apparatus 40 that printed a larger number of pages during the set period to preferentially enter the energy-saving mode, the user selects "large", as illustrated in FIG. 7. Meanwhile, in order to cause the image forming apparatus 40 that printed a smaller number of pages during the set time to preferentially enter the energy-saving mode, the user selects "small". Furthermore, in the case where the user does not take into consideration the number of pages printed by the image forming apparatuses 40 in determining the priority, the user selects "without consideration".

"Place" represents the place where an image forming apparatus 40 is installed. In the case where the user takes into consideration the place where the image forming apparatus 40 is installed, the user selects "with consideration". Meanwhile, in the case where the user does not take into consideration the place where the image forming apparatus 40 is installed, the user selects "without consideration", as illustrated in FIG. 7.

Furthermore, the user assigns priority level to the conditions to be considered in determining the priority. In the example of FIG. 7, as conditions to be considered in determining the priority, "color", "power consumption", "the number of clients", and "the number of printed pages" are selected. For example, in determining the priority, in order to assign priority levels in decreasing order of consideration, that is, "power consumption", "the number of printed pages", "color", and "the number of clients" in that order, the user assigns a priority level "1" to the condition regarding "power consumption, assigns a priority level "2" to the condition regarding "the number of printed pages", assigns a priority level "3" to the condition regarding "color", and assigns a priority level "4" to the condition regarding "the number of clients".

Furthermore, in order to shorten the transition period for the energy-saving mode on the conditions setting screen 63, the user sets the number of target image forming apparatuses 40. For example, in order to shorten the transition period for the energy-saving mode for 50% of all the image forming apparatuses 40, the user sets "the number of target apparatuses" to "50%", as illustrated in FIG. 7. When the conditions for determining the priority and the number of target apparatuses are set on the conditions setting screen 63, the CPU 51 stores the set conditions for determining the priority and the set number of target apparatuses into the storing unit 53.

(3) Power Consumption Control Operation

Figure 8:
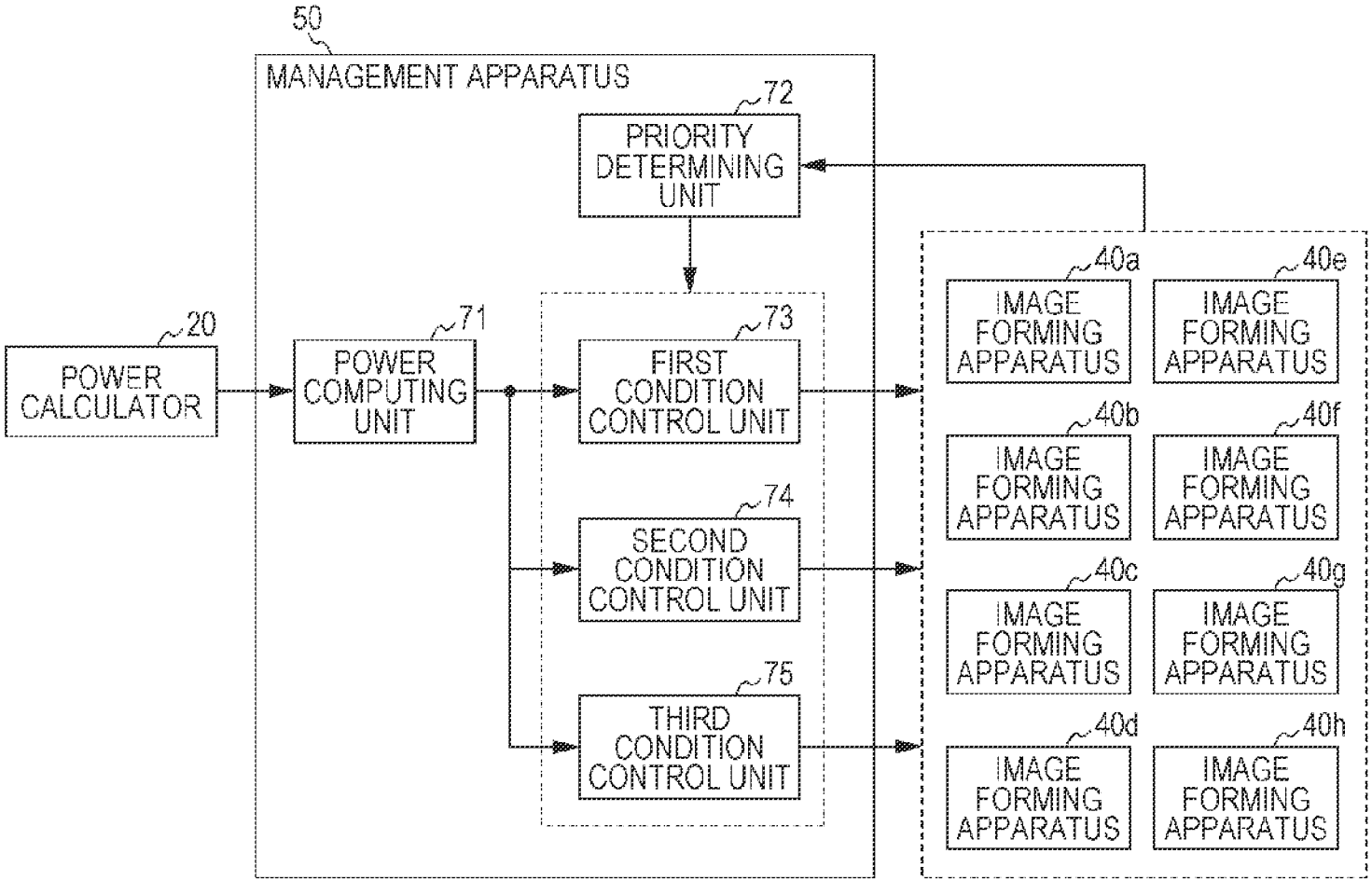
FIG. 8 is a diagram illustrating the functional configuration of a management apparatus.

An operation of the management apparatus 50 for controlling power consumption will now be explained. FIG. 8 is a diagram illustrating the functional configuration of the management apparatus 50. The management apparatus 50 functions as a power computing unit 71, a priority determining unit 72, a first condition control unit 73, a second condition control unit 74, and a third condition control unit 75. These functions are implemented when the CPU 51 executes a program stored in the memory 52. These functions may be implemented by a single program or plural programs.

(Operation of Power Computing Unit)

The power calculator 20 calculates current supplied from the switchboard 10 with specific time intervals, and transmits the current value to the management apparatus 50. The management apparatus 50 receives, at the communication unit 54, the current value transmitted from the power calculator 20. The current value received by the communication unit 54 is input to the power computing unit 71. The power computing unit 71 computes the entire power consumption of the electrical apparatuses 30, the image forming apparatuses 40, and the management apparatus 50, which are under the control of the switchboard 10, on the basis of the received current value, and outputs the computed power consumption. Specifically, the power computing unit 71 computes the power consumption by multiplying the received current value and a rated voltage (for example, 100 V) together. The power consumption output from the power calculator 20 is input to the first condition control unit 73, the second condition control unit 74, and the third condition control unit 75.

(Operation of Priority Determining Unit)

In the image forming apparatuses 40, apparatus information including apparatus IDs identifying the individual apparatuses and information on the individual apparatuses regarding the above-described "color", "power consumption", "the number of clients", "the number of printed pages", and "place" is stored in individual storing units. The priority determining unit 72 acquires the apparatus information from the individual image forming apparatuses 40 with specific time intervals. For example, at the time when the management apparatus 50 receives a current value from the power calculator 20, the priority determining unit 72 acquires apparatus information from the individual image forming apparatuses 40. Apparatus information may not be stored in the image forming apparatuses 40. For example, apparatus information of the individual image forming apparatuses 40 may be input and registered in advance to the management apparatus 50. When acquiring the apparatus information, the priority determining unit 72 collects the acquired apparatus information to create an apparatus information database 64, and the apparatus information database 64 is stored into the storing unit 53. FIG. 9 is a diagram illustrating an example of the apparatus information database 64. The priority determining unit 72 determines the priority levels for the image forming apparatuses 40 on the basis of the priority determining conditions and the apparatus information database 64 stored in the storing unit 53. In the explanation provided below, the image forming apparatuses 40 having apparatus IDs of "a" to "h" are referred to as "image forming apparatuses 40*a* to 40*h*", respectively.

Specifically, the priority determining unit 72 specifies a highest-priority condition of the priority determining conditions stored in the storing unit 53. For the priority determining conditions illustrated in FIG. 7, the condition that the "power consumption" is "large" has the highest priority level "1". In this case, the priority determining unit 72 first determines the priority levels in descending order of power consumption. In the apparatus information database 64 illustrated in FIG. 9, the power consumption by the image forming apparatus 40*b*, which is "300", is the largest. The power consumption by the image forming apparatus 40*a*, which is "200", is the second largest. The power consumption by each of the image forming apparatuses 40*c*, 40*d*, 40*f*, and 40*g*, which is "150", is the third largest. The power consumption by each of the image forming apparatuses 40*e* and 40*h*, which is "120", is the smallest. In this case, the priority determining unit 72 determines the priority level "1" for the image forming apparatus 40*b*, and determines the priority level "2" for the image forming apparatus 40*a*.

Here, since the third largest power is consumed by each of the image forming apparatuses 40*c*, 40*d*, 40*f*, and 40*g*, the priority levels are not determined for the image forming apparatuses 40*c*, 40*d*, 40*f*, and 40*g* on the basis of the magnitude of power consumption. In this case, the priority determining unit 72 specifies the second-highest-priority condition of the priority determining conditions stored in the storing unit 53. For the priority determining conditions illustrated in FIG. 7, the condition that "the number of printed pages" is "large" has the second-highest priority. In this case, the priority determining unit 72 determines priority levels for the image forming apparatuses 40*c*, 40*d*, 40*f*, and 40*g* in descending order of the number of printed pages. For the apparatus information database 64 illustrated in FIG. 9, the number of pages printed by the image forming apparatus 40*c*, which is "529", is the largest. The number of pages printed by the image forming apparatus 40*f*, which is "324", is the second largest. The number of pages printed by the image forming apparatus 40*g*, which is "118", is the third largest. The number of pages printed by the image forming apparatus 40*d*, which is "102", is the smallest. In this case, the priority determining unit 72 determines the priority level "3" for the image forming apparatus 40*c*, determines the priority level "4" for the image forming apparatus 40*f*, determines the priority level "5" for the image forming apparatus 40*g*, and determines the priority level "6" for the image forming apparatus 40*d*.

Furthermore, since the smallest power is consumed by each of the image forming apparatuses 40*e* and 40*h*, the priority levels are not determined for the image forming apparatuses 40*e* and 40*h* on the basis of the magnitude of power consumption. In this case, similarly to the case described above, the priority determining unit 72 determines priority levels for the image forming apparatuses 40*e* and 40*h* in descending order of number of printed pages. For the apparatus information database 64 illustrated in FIG. 9, the number of pages printed by the image forming apparatus 40*e*, which is "87", is the largest, and the number of pages printed by the image forming apparatus 40*h*, "which is 55", is the smallest. In this case, the priority determining unit 72 determines the priority level "7" for the image forming apparatus 40*e*, and determines the priority level "8" for the image forming apparatus 40*h*.

As described above, the priority determining unit 72 first specifies the highest-priority condition, and determines priority levels for the image forming apparatuses 40 on the basis of the specified condition. However, in the case where priority levels are not determined on the basis of the specified condition, such as, for example, in the case where plural image forming apparatuses 40 satisfy the same condition, the priority determining unit 72 specifies the second-highest-priority condition, and determines priority levels for the image forming apparatuses 40 on the basis of the specified condition. As described above, the priority determining unit 72 determines priority levels for the image forming apparatuses 40 taking into consideration a higher-priority condition more preferentially than the other conditions.

(Operation of First Condition Control Unit)

Figure 10:
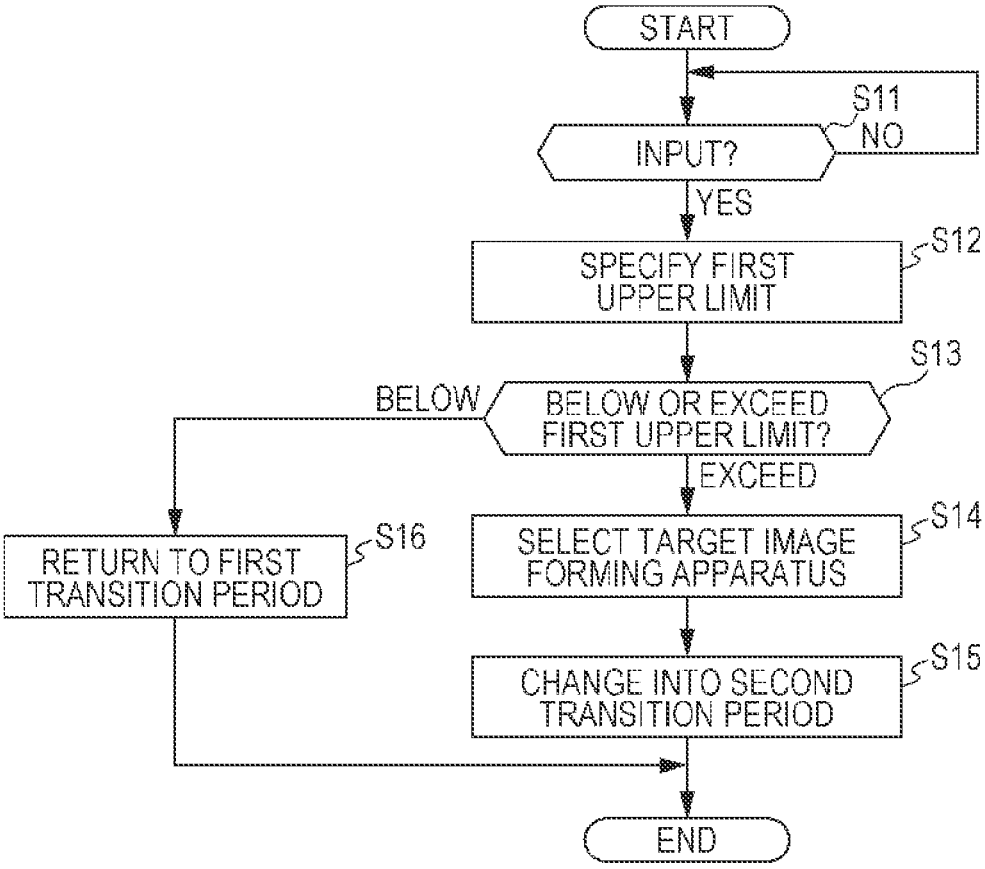
FIG. 10 is a flowchart illustrating the operation of a first condition control unit.

The first condition control unit 73 shortens the transition period for the energy-saving mode for the image forming apparatuses 40 when the power consumption received from the power computing unit 71 exceeds the first upper limit. FIG. 10 is a flowchart illustrating the operation of the first condition control unit 73.

The first condition control unit 73 determines whether or not the power consumption is input from the power computing unit 71 (step S11), and waits until the power consumption is input (NO in step S11). When the power consumption is input (YES in step S11), the first condition control unit 73 specifies the first upper limit corresponding to the current time on the basis of the target value 61 stored in the storing unit 53 (step S12). For example, when the current time is between 12:00 and 13:00, the first condition control unit 73 specifies "5", which is the first upper limit corresponding to 12:00, on the basis of the target value 61 of power consumption illustrated in FIG. 4.

The first condition control unit 73 determines whether the input power consumption exceeds the specified first upper limit or falls below the specified first upper limit (step S13). When the input power consumption is equal to the first upper limit, the first condition control unit 73 terminates the processing. When the power consumption exceeds the first upper limit (the determination in step S13 is "exceed"), the first condition control unit 73 selects a target image forming apparatus 40 on the basis of the priority determined by the priority determining unit 72 and the number of target apparatuses stored in the storing unit 53 (step S14). For example, when the number of target apparatuses is "50%", as illustrated in FIG. 7, 50 percent of the total number of image forming apparatuses 40*a* to 40*h*, that is, four image forming apparatuses 40, are set as target apparatuses. In this case, the first condition control unit 73 selects four image forming apparatuses 40 having high priority levels, that is, the image forming apparatuses 40*b*, 40*a*, 40*c*, and 40*f* whose priority levels are "1", "2", "3", and "4", respectively, as illustrated in FIG. 9.

The first condition control unit 73 sets the transition period for the energy-saving mode for the image forming apparatuses 40 selected in step S14 to the second transition period (step S15). Specifically, the first condition control unit 73 specifies the second transition period stored in the storing unit 53, and transmits to the image forming apparatuses 40*b*, 40*a*, 40*c*, and 40*f*, using the communication unit 54, instructions for setting the transition period for the energy-saving mode to the second transition period. When receiving the instructions transmitted from the management apparatus 50, the image forming apparatuses 40*b*, 40*a*, 40*c*, and 40*f* change the transition period for the energy-saving mode from the first transition period to the second transition period, which is shorter than the first transition period, in accordance with the received instructions.

Furthermore, in the case where the power consumption falls below the first upper limit (the determination in step S13 is "below") in the above-described determination in step S13, the first condition control unit 73 returns the transition period for the energy-saving mode for the image forming apparatuses 40 selected in step S14 from the second transition period to the first transition period. Specifically, the first condition control unit 73 transmits to the image forming apparatuses 40*b*, 40*a*, 40*c*, and 40*f*, using the communication unit 54, instructions for returning the transition period for the energy-saving mode to the first transition period. When receiving the instructions transmitted from the management apparatus 50, the image forming apparatuses 40*b*, 40*a*, 40*c*, and 40*f* return the transition period for the energy-saving mode from the second transition period to the first transition period in accordance with the received instructions.

(Operation of Second Condition Control Unit)

Figure 11:
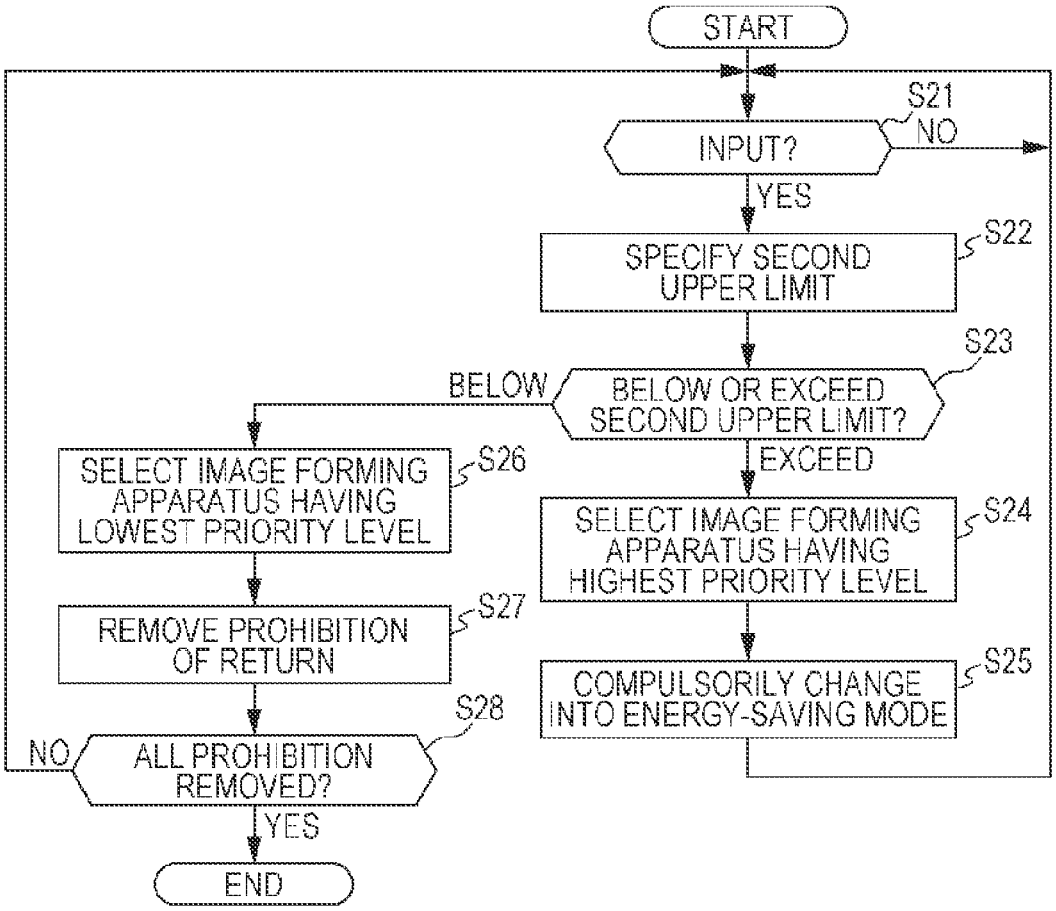
FIG. 11 is a flowchart illustrating the operation of a second condition control unit.

When the power consumption input from the power computing unit 71 exceeds the second upper limit, the second condition control unit 74 compulsorily causes the image forming apparatuses 40 to enter the energy-saving mode. FIG. 11 is a flowchart illustrating the operation of the second condition control unit 74.

The second condition control unit 74 determines whether or not the power consumption is input from the power computing unit 71 (step S21), and waits until the power consumption is input (NO in step S21). When the power consumption is input (YES in step S21), the second condition control unit 74 specifies the second upper limit corresponding to the current time on the basis of the target value 61 stored in the storing unit 53 (step S22). For example, in the case where the current time is between 12:00 and 13:00, the second condition control unit 74 specifies "7", which is the second upper limit corresponding to 12:00, on the basis of the target value 61 illustrated in FIG. 4.

The second condition control unit 74 determines whether the input power consumption exceeds the specified second upper limit or falls below the specified second upper limit (step S23). When the input power consumption is equal to the second upper limit, the second condition control unit 74 terminates the processing. When the power consumption exceeds the second upper limit (the determination in step S23 is "exceed"), the second condition control unit 74 selects the image forming apparatus 40 having the highest priority level determined by the priority determining unit 72 among the image forming apparatuses 40 that are not compulsorily caused to enter the energy-saving mode (step S24). For example, in the case where no image forming apparatuses 40*a* to 40*h* are compulsorily caused to enter the energy-saving mode, the image forming apparatus 40*b* has the highest priority level "1" among the image forming apparatuses 40*a* to 40*h* illustrated in FIG. 9. In this case, the second condition control unit 74 selects the image forming apparatus 40*b*.

The second condition control unit 74 compulsorily causes the image forming apparatus 40 selected in step S24 to enter the energy-saving mode (step S25). Specifically, the second condition control unit 74 transmits to the image forming apparatus 40*b*, using the communication unit 54, an instruction for compulsorily causing the image forming apparatus 40*b* to enter the energy-saving mode. When receiving the instruction transmitted from the management apparatus 50, the image forming apparatus 40*b* immediately enters the energy-saving mode in accordance with the received instruction. In the case where the image forming apparatus 40*b* is compulsorily caused to enter the energy-saving mode as described above, the image forming apparatus 40*b* is prohibited from returning to the normal operation mode even if the image forming apparatus 40*b* satisfies the return condition.

After performing the processing of step S25, the second condition control unit 74 returns to step S21. The second condition control unit 74 repeats the processing of steps S21 to S25 as long as the power consumption exceeds the second upper limit in step S23. Here, the second condition control unit 74 selects, one by one, the image forming apparatuses 40*a* to 40*h* in descending order of priority in step S24. For example, in the case where the second condition control unit 74 proceeds to step S24 after compulsorily causing the image forming apparatus 40*b* to enter the energy-saving mode as described above, the image forming apparatus 40*a* has the highest priority level "2" among the image forming apparatuses 40*a* and 40*c* to 40*h* that are not compulsorily caused to enter the energy-saving mode. In this case, the second condition control unit 74 selects the image forming apparatus 40*a* in step S24. Accordingly, the image forming apparatuses 40*a* to 40*h* are compulsorily caused to enter the energy-saving mode, one by one, until the power consumption reaches the second upper limit or less.

As described above, in the case where an image forming apparatus 40 is compulsorily caused to enter the energy-saving mode, the image forming apparatus 40 does not return to the normal operation mode even if the image forming apparatus 40 satisfies the return condition for returning to the normal operation mode. Thus, for example, even if image information is input from a client apparatus to the image forming apparatus 40, the image forming apparatus 40 does not form an image. Therefore, in the case where an image forming apparatus 40 is compulsorily caused to enter the energy-saving mode, when image information is input from a client apparatus to the image forming apparatus 40, the image forming apparatus 40 transfers the image information to a different image forming apparatus 40 and requests the different image forming apparatus 40 to form an image. In this case, the image forming apparatus 40 notifies the client apparatus of the different image forming apparatus 40 to which the request is sent.

When the power consumption falls below the second upper limit in step S23 (the determination in step S23 is "below"), the second condition control unit 74 selects the image forming apparatus 40 having the lowest priority level determined by the priority determining unit 72 among the image forming apparatuses 40 that are compulsorily caused to enter the energy-saving mode (step S26). For example, in the case where the image forming apparatuses 40*a* and 40*b* are compulsorily caused to enter the energy-saving mode, the image forming apparatus 40*a* has the lowest priority level "2" of the image forming apparatuses 40*a* and 40*b* illustrated in FIG. 9. In this case, the second condition control unit 74 selects the image forming apparatus 40*a*.

The second condition control unit 74 removes the prohibition of return to the normal operation mode for the image forming apparatus 40 selected in step S26 (step S27). Specifically, the second condition control unit 74 transmits to the image forming apparatus 40*a*, using the communication unit 54, an instruction for removing the prohibition of return to the normal operation mode. When receiving the instruction transmitted from the management apparatus 50, the image forming apparatus 40*a* removes the prohibition of return to the normal operation mode in accordance with the received instruction. After the prohibition of return to the normal operation mode is removed, the image forming apparatus 40*a* returns to the normal operation mode when the image forming apparatus 40*a* satisfies the return condition.

The second condition control unit 74 determines whether or not the prohibition of return to the normal operation mode for all the image forming apparatuses 40 has been removed (step S28). Specifically, when all the image forming apparatuses 40 selected in step S24 are selected in step S26, the second condition control unit 74 determines that the prohibition of return to the normal operation mode for all the image forming apparatuses 40 has been removed. Meanwhile, all the image forming apparatuses 40 selected in step S24 are not selected in step S26, the second condition control unit 74 determines that the prohibition of return to the normal operation mode for all the image forming apparatuses 40 has not been removed.

When the prohibition of return to the normal operation mode for all the image forming apparatuses 40 has not been removed (NO in step S28), the second condition control unit 74 returns to step S21. Then, the second condition control unit 74 repeats the processing of steps S26 to S28 as long as the power consumption is below the second upper limit. Here, the second condition control unit 74 selects, one by one, the image forming apparatuses 40 that are compulsorily caused to enter the energy-saving mode in ascending order of priority in step S26. For example, in the case where the second condition control unit 74 proceeds to step S26 after the prohibition of return to the normal operation mode for the image forming apparatus 40*a* is removed as described above, since only the image forming apparatus 40*b* is prohibited from returning to the normal operation mode, the image forming apparatus 40*b* has the lowest priority level "1". In this case, the second condition control unit 74 selects the image forming apparatus 40*b*. Accordingly, the prohibition of return to the normal operation mode for the image forming apparatuses 40 that are compulsorily caused to enter the energy-saving mode is removed, one by one, in descending order of priority as long as the power consumption is below the second upper limit.

(Operation of Third Condition Control Unit)

Figure 12:
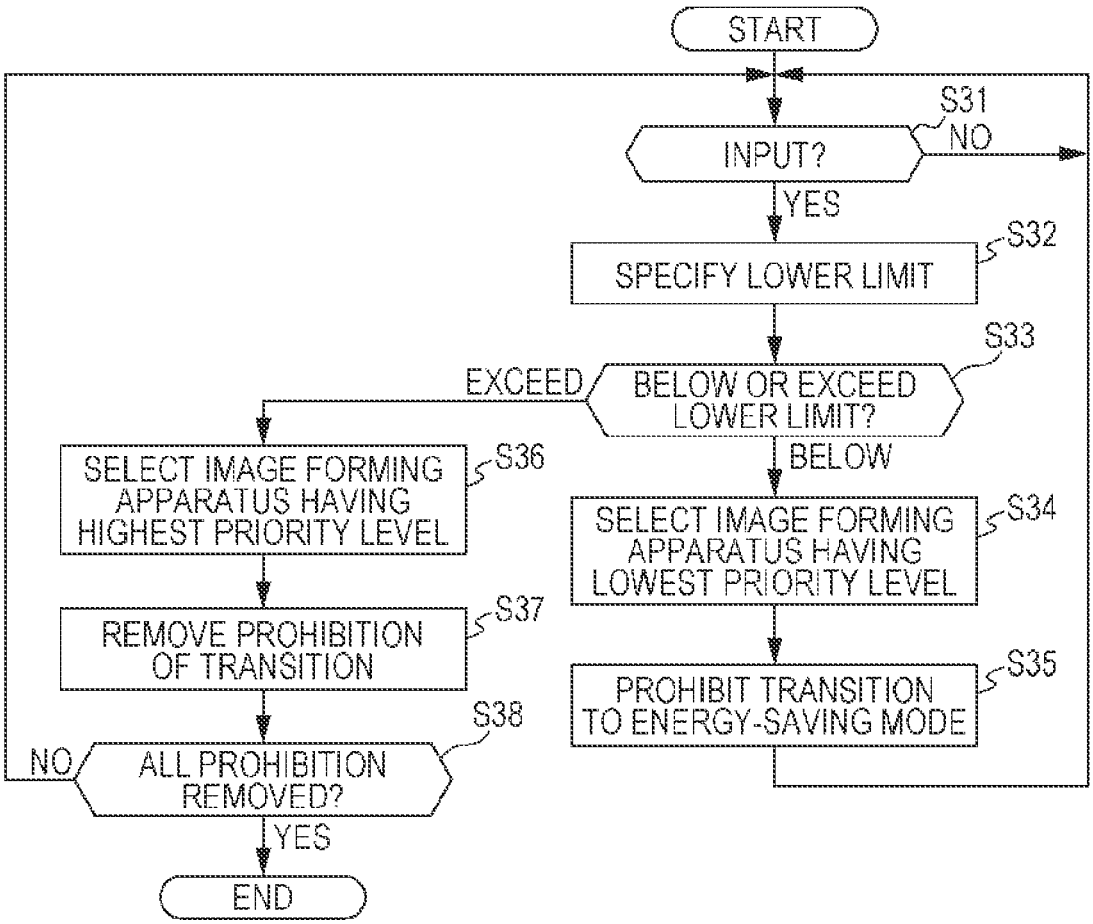
FIG. 12 is a flowchart illustrating the operation of a third condition control unit.

When the power consumption input from the power computing unit 71 falls below the lower limit, the third condition control unit 75 prohibits the image forming apparatuses 40 from entering the energy-saving mode. FIG. 12 is a flowchart illustrating the operation of the third condition control unit 75.

The third condition control unit 75 determines whether or not the power consumption is input from the power computing unit 71 (step S31), and waits until the power consumption is input (NO in step S31). When the power consumption is input (YES in step S31), the third condition control unit 75 specifies the lower limit corresponding to the current time on the basis of the target value 61 stored in the storing unit 53 (step S32). For example, in the case where the current time is between 12:00 and 13:00, the third condition control unit 75 specifies the lower limit "1.5", which is the lower limit corresponding to 12:00, on the basis of the target value 61 illustrated in FIG. 4.

The third condition control unit 75 determines whether the input power consumption falls below the specified lower limit or exceeds the specified lower limit (step S33). When the input power consumption is equal to the lower limit, the third condition control unit 75 terminates the processing. When the power consumption falls below the lower limit (the determination in step S33 is "below"), the third condition control unit 75 selects the image forming apparatus 40 having the lowest priority level determined by the priority determining unit 72 among the image forming apparatuses 40 that are not prohibited from entering the energy-saving mode (step S34). For example, in the case where none of the image forming apparatuses 40*a* to 40*h* is prohibited from entering the energy-saving mode, the image forming apparatus 40*h* has the lowest priority level "8" among the image forming apparatuses 40*a* to 40*h* illustrated in FIG. 9. In this case, the third condition control unit 75 selects the image forming apparatus 40*h*.

The third condition control unit 75 prohibits the image forming apparatus 40 selected in step S34 from entering the energy-saving mode (step S35). Specifically, the third condition control unit 75 transmits to the image forming apparatus 40*h*, using the communication unit 54, an instruction for prohibiting the image forming apparatus 40*h* from entering the energy-saving mode. When receiving the instruction transmitted from the management apparatus 50, the image forming apparatus 40*h* is prohibited from entering the energy-saving mode in accordance with the received instruction. In the case where the image forming apparatus 40*h* is prohibited from entering the energy-saving mode as described above, the image forming apparatus 40*h* continues to operate in the normal operation mode, without entering the energy-saving mode even if the image forming apparatus 40*h* satisfies the transition condition for the energy-saving mode. In the case where the image forming apparatus 40*h* is in the energy-saving mode, the image forming apparatus 40*h* may return to the normal operation mode and then be prohibited from entering the energy-saving mode.

After performing the processing of step S35, the third condition control unit 75 returns to step S31. The third condition control unit 75 repeats the processing of steps S31 to S35 as long as the power consumption is below the lower limit in step S33. Here, the third condition control unit 75 selects, one by one, the image forming apparatuses 40*a* to 40*h* in ascending order of priority in step S34. For example, in the case where the third condition control unit 75 proceeds to step S34 after the image forming apparatus 40*h* is prohibited from entering the energy-saving mode as described above, the image forming apparatus 40*e* has the lowest priority level "7" among the image forming apparatuses 40*a* to 40*g* that are not prohibited from entering the energy-saving mode. In this case, the third condition control unit 75 selects the image forming apparatus 40*e*. Accordingly, the image forming apparatuses 40*a* to 40*h* are prohibited from entering the energy-saving mode, one by one, in ascending order of priority as long as the power consumption is below the lower limit.

When the power consumption exceeds the lower limit in step S33 (the determination in step S33 is "exceed"), the third condition control unit 75 selects the image forming apparatus 40 having the highest priority level determined by the priority determining unit 72 among the image forming apparatuses 40 that are prohibited from entering the energy-saving mode (step S36). For example, in the case where the image forming apparatuses 40*e* and 40*h* are prohibited from entering the energy-saving mode, the image forming apparatus 40*e* has the highest priority level "7" of the image forming apparatuses 40*e* and 40*h* illustrated in FIG. 9. In this case, the third condition control unit 75 selects the image forming apparatus 40*e*.

The third condition control unit 75 removes the prohibition of entry to the energy-saving mode for the image forming apparatus 40 selected in step S36 (step S37). Specifically, the third condition control unit 75 transmits to the image forming apparatus 40*e*, using the communication unit 54, an instruction for removing the prohibition of entry to the energy-saving mode. When receiving the instruction transmitted from the management apparatus 50, the image forming apparatus 40*e* removes the prohibition of entry to the energy-saving mode in accordance with the received instruction. After the prohibition of entry to the energy-saving mode is removed, the image forming apparatus 40*e* enters the energy-saving mode when the image forming apparatus 40*e* satisfies the transition condition for entering the energy-saving mode.

The third condition control unit 75 determines whether or not the prohibition of entry to the energy-saving mode for all the image forming apparatuses 40 has been removed (step S38). Specifically, in the case where all the image forming apparatuses 40 selected in step S34 are selected in step S36, the third condition control unit 75 determines that the prohibition of entry to the energy-saving mode for all the image forming apparatuses 40 has been removed. Meanwhile, in the case where all the image forming apparatuses 40 selected in step S34 are not selected in step S36, the third condition control unit 75 determines that the prohibition of entry to the energy-saving mode for all the image forming apparatuses 40 has not been removed.

In the case where the prohibition of entry to the energy-saving mode for all the image forming apparatuses 40 has not been removed (NO in step S38), the third condition control unit 75 returns to step S31 and repeats the processing of steps S36 to S38 as long as the power consumption exceeds the lower limit. Here, the third condition control unit 75 selects, one by one, the image forming apparatuses 40 that are prohibited from entering the energy-saving mode in descending order of priority. For example, in the case where the third condition control unit 75 proceeds to step S36 after the prohibition of entry to the energy-saving mode for the image forming apparatus 40*e* is removed as described above, since only the image forming apparatus 40*h* is prohibited from entering the energy-saving mode, the image forming apparatus 40*h* has the highest priority level "8". In this case, the third condition control unit 75 selects the image forming apparatus 40*h*. Accordingly, the prohibition of entry to the energy-saving mode for the image forming apparatuses 40 that are prohibited from entering the energy-saving mode are removed one by one in descending order of priority as long as the power consumption exceeds the lower limit.

In the exemplary embodiment described above, in the case where the power consumption exceeds the first upper limit, since the transition period for the energy-saving mode for the image forming apparatuses 40 is shortened, the image forming apparatuses 40 easily enter the energy-saving mode. Accordingly, the power consumption is easy to reduce. Furthermore, in the case where the power consumption exceeds the second upper limit, the image forming apparatuses 40 are compulsorily caused to enter the energy-saving mode. Accordingly, an increase in the power consumption is suppressed. Furthermore, in the case where the image forming apparatuses 40 are compulsorily caused to enter the energy-saving mode, the image forming apparatuses 40 are prohibited from returning to the normal operation mode. Accordingly, an increase in the power consumption is more suppressed. Furthermore, in the case where the power consumption is below the lower limit, the image forming apparatuses 40 are prohibited from entering the energy-saving mode. In this case, since the image forming apparatuses 40 maintain the normal operation mode, the image forming apparatuses 40 start image forming operation immediately after receiving an image forming instruction issued from a user. Accordingly, the user-friendliness of the image forming apparatuses 40 is improved.

3. Modifications

The above-described exemplary embodiment is merely an example of the present invention, and the present invention is not limited to the above-described exemplary embodiment. The above-described exemplary embodiment may be modified and implemented as described below. Furthermore, the modifications explained below may be combined together.

(1) First Modification

Figure 13:
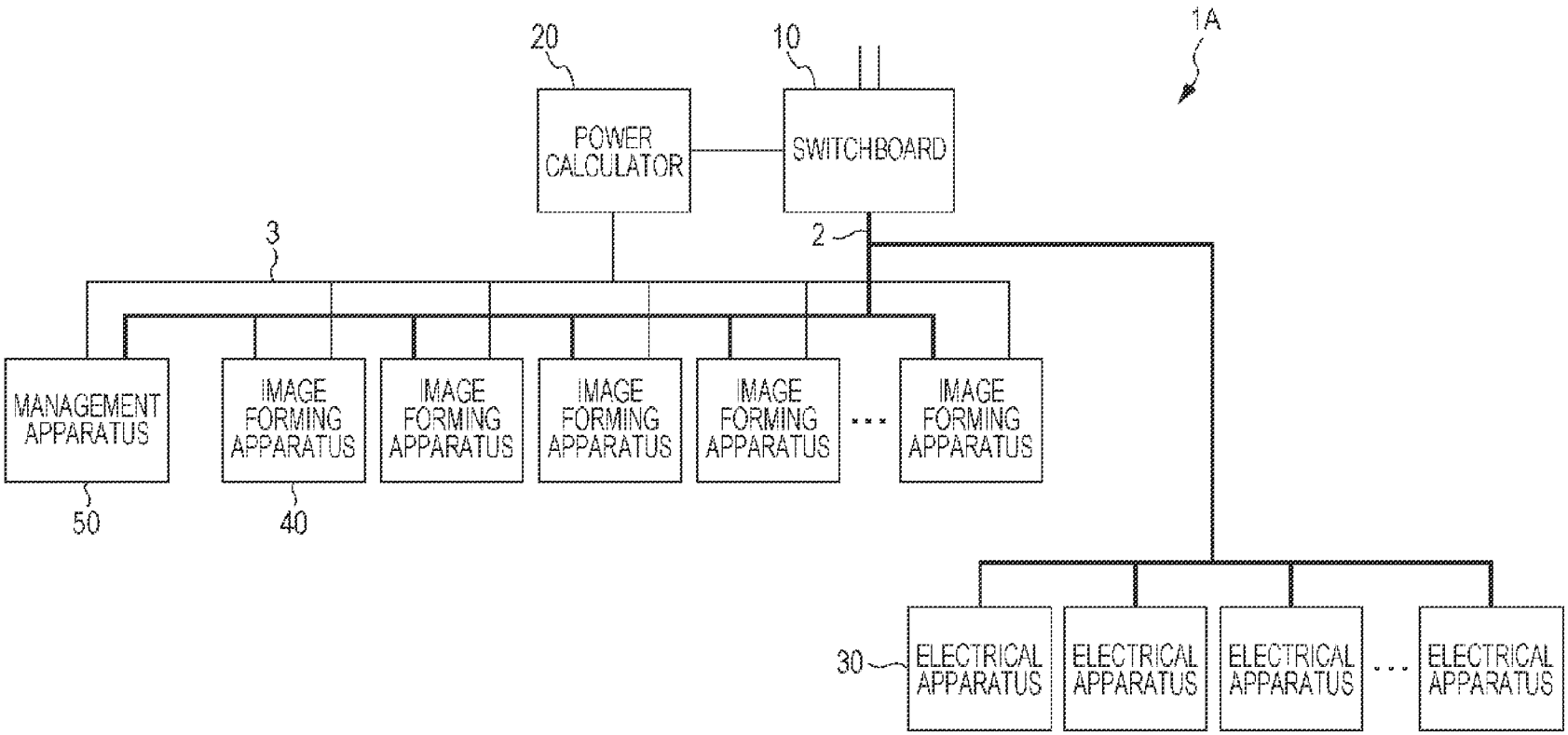
FIG. 13 is a diagram illustrating the configuration of a power control system according to a modification.
Figure 14:
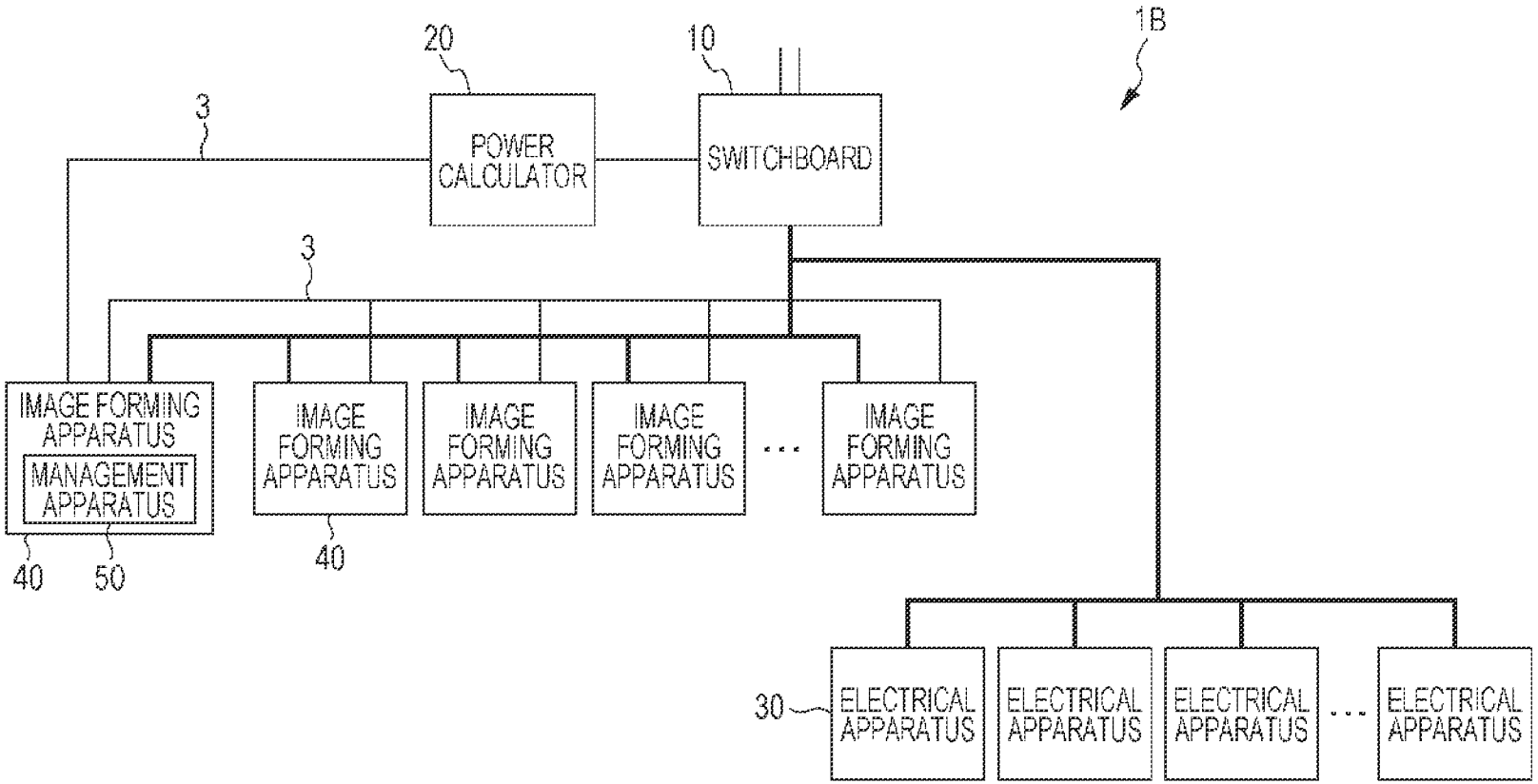
FIG. 14 is a diagram illustrating the configuration of a power control system according to a modification.
Figure 15:
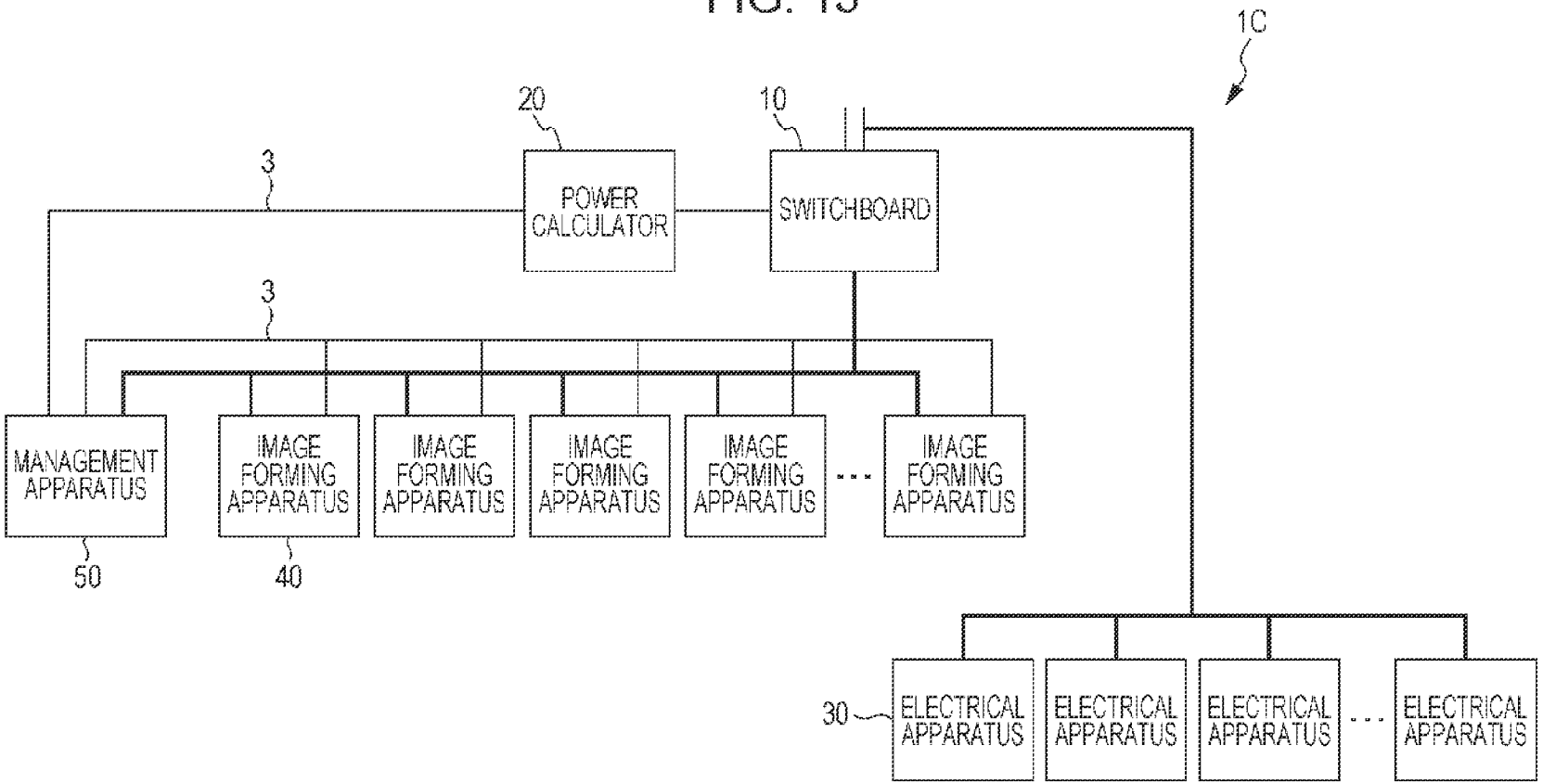
FIG. 15 is a diagram illustrating the configuration of a power control system according to a modification.

The configuration of the power control system 1 is not limited to the configuration illustrated in FIG. 1. FIGS. 13 to 15 are diagrams illustrating the configurations of power control systems 1A to 1C according to modifications, respectively. In the power control system 1 illustrated in FIG. 1, the management apparatus 50 and the power calculator 20 are connected to each other via the dedicated communication line 3. Meanwhile, in the power control system 1A illustrated in FIG. 13, the power calculator 20, the management apparatus 50, and the image forming apparatuses 40 are connected to one another via the common communication line 3.

In the power control system 1 illustrated in FIG. 1, the management apparatus 50 is arranged separately from the image forming apparatuses 40. Meanwhile, in the power control system 1B illustrated in FIG. 14, the management apparatus 50 is arranged in one of the image forming apparatuses 40, and the image forming apparatus 40 including the management apparatus 50 functions as the management apparatus 50. In this case, the image forming apparatus 40 including the management apparatus 50 has the configuration similar to that of the management apparatus 50 and operates similarly to the management apparatus 50.

In the power control system 1 illustrated in FIG. 1, the image forming apparatuses 40, the electrical apparatuses 30, and the management apparatus 50 are connected to one another under the control of the switchboard 10. Meanwhile, in the power control system 1C illustrated in FIG. 15, only the image forming apparatuses 40 and the management apparatus 50 are connected to one another under the control of the switchboard 10 and the electrical apparatuses 30 are not connected under the control of the switchboard 10. With this configuration, power is supplied to the electrical apparatuses 30 from a power system different from that for the image forming apparatuses 40 and the management apparatus 50. In this case, the power calculator 20 calculates the current supplied from the switchboard 10 to the image forming apparatuses 40 and the management apparatus 50. The management apparatus 50 computes the power consumption of the image forming apparatuses 40 and the management apparatus 50, and controls the operation mode of the image forming apparatuses 40 on the basis of the computed power consumption.

Furthermore, in the power control system 1C, only the image forming apparatuses 40 may be connected under the control of the switchboard 10. With this configuration, power may be supplied to the electrical apparatuses 30 and the management apparatus 50 from a power system different from that for the image forming apparatuses 40. In this case, the power calculator 20 calculates the current supplied from the switchboard 10 to the image forming apparatuses 40. The management apparatus 50 computes the power consumption of the image forming apparatuses 40, and controls the operation mode of the image forming apparatuses 40 on the basis of the computed power consumption. As described above, power may be supplied from the switchboard 10 to the image forming apparatuses 40 and a different apparatus (for example, the electrical apparatuses 30 or the management apparatus 50) or only to the image forming apparatuses 40.

(2) Second Modification

In the embodiment described above, a user sets a desired value as the target value 61 of power consumption. However, the target value 61 may be determined in accordance with the history of power consumption. In this case, the CPU 51 stores the history of the power consumption computed by the power computing unit 71 into the storing unit 53. The user operates the management apparatus 50 using the operation unit 55 to set setting conditions for the target value 61 of power consumption. Here, the CPU 51 displays a target setting screen 65 on the display unit 56 in accordance with an instruction from the user.

Figure 16:
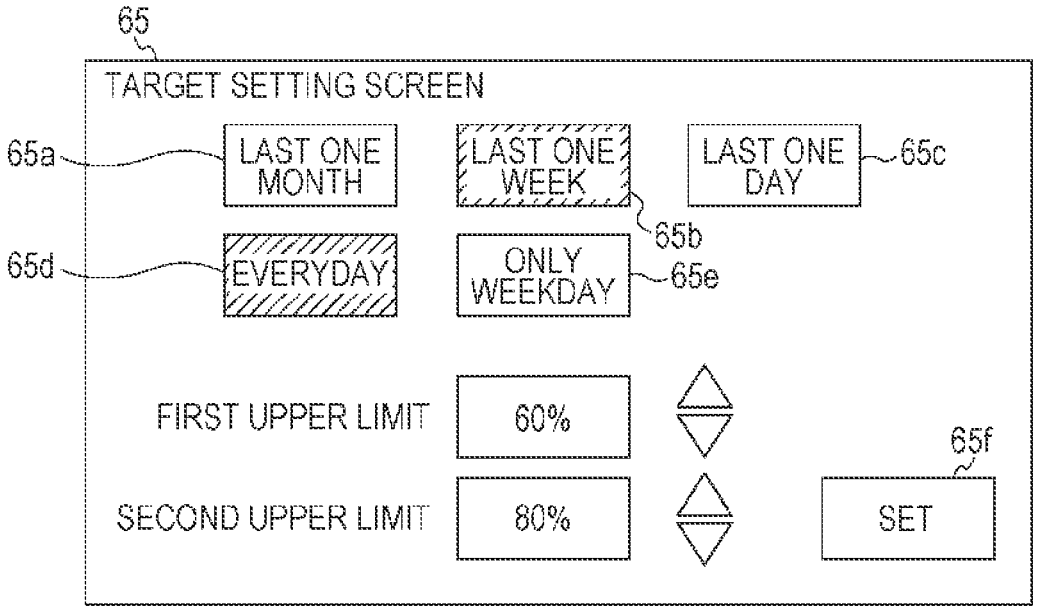
FIG. 16 is a diagram illustrating an example of a target setting screen according to a modification.

FIG. 16 is a diagram illustrating an example of the target setting screen 65. A user selects, on the target setting screen 65, the period of the history of power consumption to be used. For example, in order to use the history of power consumption for the last one month, the user presses a button 65*a* representing the "last one month". In order to use the history of power consumption for the last one week, the user presses a button 65*b* representing the "last one week". In order to use the history of power consumption for the last one day, the user presses a button 65*c* representing the "last one day". Furthermore, the user selects whether the history of everyday power consumption or the history of weekday power consumption for the set period is to be used. For example, in order to use the history of everyday power consumption, the user presses a button 65*d* representing "everyday". In order to use the history of only weekday power consumption, the user presses a button 65*e* representing "only weekday". Furthermore, the user specifies the percentages of the first upper limit and the second upper limit relative to the average value of the history of power consumption. For example, in order to set 60% of the average value of history of power consumption for the first upper limit, the user sets "60%" for the percentage of the first upper limit. In order to set "80%" of the average value of history of power consumption for the second upper limit, the user sets "80%" for the percentage of the second upper limit. After setting of the setting conditions for the target value 61 of power consumption is completed, the user presses a set button 65*f*.

Here, as illustrated in FIG. 16, it is assumed that use of the history of everyday power consumption for the last one week is selected, "60%" is set for the percentage of the first upper limit, and "80%" is set for the percentage of the second upper limit. When the set button 65*f* is pressed, the CPU 51 extracts the history for the last one week from the history of the power consumption stored in the storing unit 53. The CPU 51 computes the average value of the power consumption for the last one week using the extracted history. The CPU 51 computes the value of "60%" of the average of power consumption as the first upper limit. The CPU 51 also computes the value of "80%" of the average value of power consumption as the second upper limit. The CPU 51 stores the computed first upper limit and second upper limit into the storing unit 53. The lower limit as well as the first upper limit and the second upper limit may be computed from the average value of power consumption and stored into the storing unit 53 as in the description provided above.

(3) Third Modification

Figure 17:
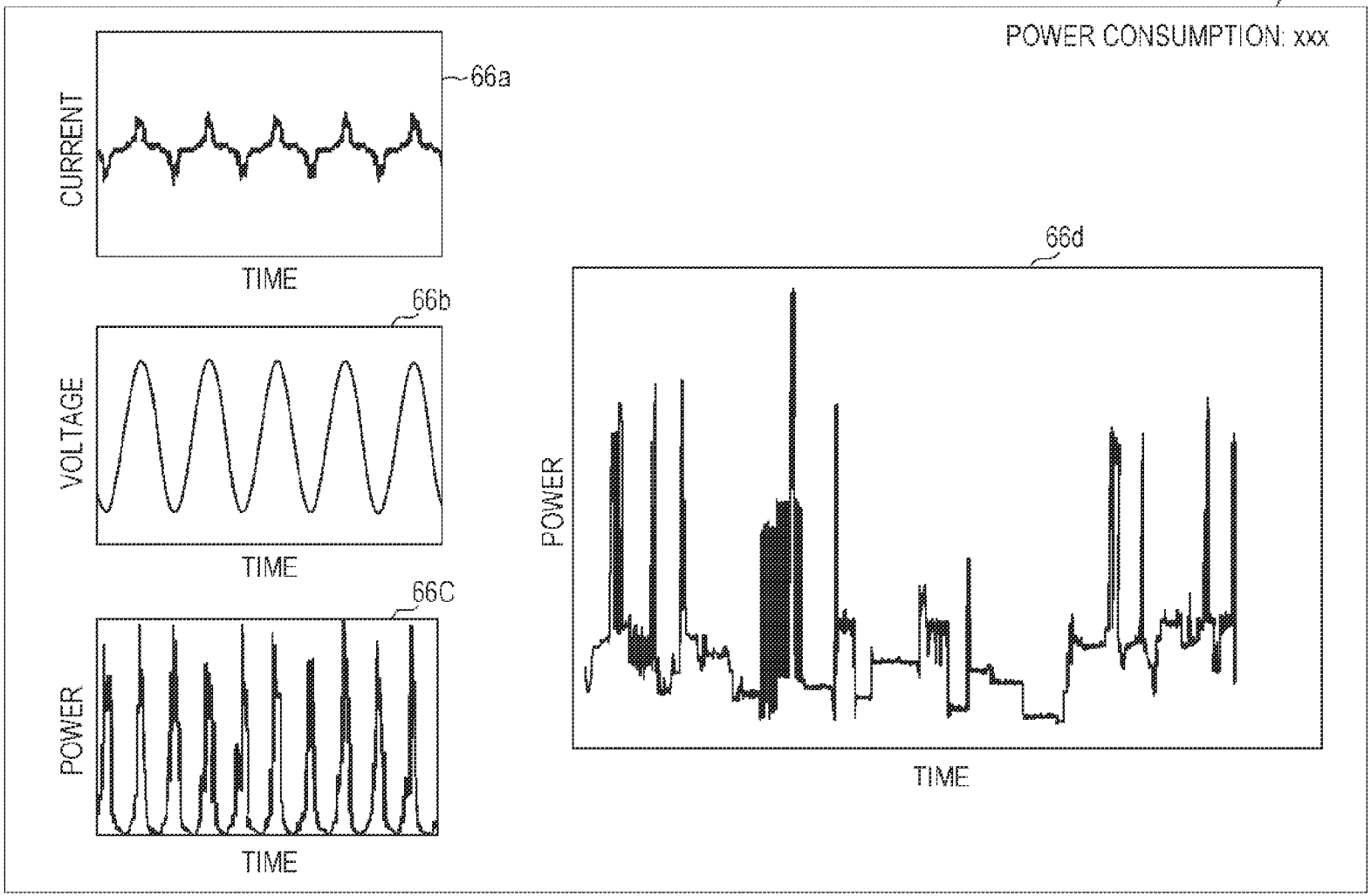
FIG. 17 is a diagram illustrating an example of power consumption information according to a modification.

The management apparatus 50 may display power consumption information 66 regarding power consumption on the display unit 56. FIG. 17 is a diagram illustrating an example of the power consumption information 66. As illustrated in FIG. 17, the power consumption information 66 includes the power consumption "xxx" computed by the power computing unit 71, a current waveform 66*a* representing the current value calculated by the power calculator 20 along the time axis, a voltage waveform 66*b* representing the rated voltage value along the time axis, and power waveforms 66*c* and 66*d* representing the power value calculated by the power calculator 20 along the time axis. The power waveforms 66*c* and 66*d* have different scales of the time axis. Furthermore, the management apparatus 50 may transmit, using the communication unit 54, the power consumption information 66 to the image forming apparatuses 40 and may display the power consumption information 66 on the image forming apparatuses 40. Alternatively, the management apparatus 50 may transmit, using the communication unit 54, the power consumption information 66 to an external display apparatus and may display the power consumption information 66 on the external display apparatus. Accordingly, by making power consumption visible as described above, increasing the user's awareness of power saving is expected.

(4) Fourth Modification

In the embodiment described above, the first condition control unit 73, the second condition control unit 74, and the third condition control unit 75 may select an image forming apparatus 40 taking into consideration the place where the image forming apparatus 40 is installed. Specifically, for selection of an image forming apparatus 40 in step S14, the first condition control unit 73 determines, on the basis of the apparatus information database 64 stored in the storing unit 53, whether the image forming apparatus 40 to be selected satisfies the condition that a different image forming apparatus 40 that is installed at the same place as the image forming apparatus 40 to be selected is selected or the condition that no other image forming apparatus 40 is installed at the same place as the image forming apparatus 40 to be selected. When the image forming apparatus 40 to be selected satisfies one of the above-described conditions, the first condition control unit 73 selects the image forming apparatus 40 having the next highest priority level, without selecting the image forming apparatus 40 to be selected.

Furthermore, in the case where one image forming apparatus 40 is selected at every place where the image forming apparatuses 40 are installed or in the case where only one image forming apparatus 40 is installed at every place where the image forming apparatuses 40 are installed, the first condition control unit 73 selects an image forming apparatus 40 in accordance with the priority, as in the embodiment described above. However, even in this case, when the image forming apparatus 40 to be selected satisfies the condition that all the other image forming apparatuses 40 installed at the same place as the image forming apparatus 40 to be selected are selected or the condition that no other image forming apparatus 40 is installed at the same place as the image forming apparatus 40 to be selected, the first condition control unit 73 selects the image forming apparatus 40 having the next highest priority level, without selecting the image forming apparatus 40 to be selected. Furthermore, in the case where only one image forming apparatus 40 is unselected at every place where the image forming apparatuses 40 are installed or only one image forming apparatus 40 exists at every place where the image forming apparatuses 40 are installed, the first condition control unit 73 selects an image forming apparatus 40 in accordance with the priority, as in the embodiment described above.

For selection of an image forming apparatus 40 in step S24, the second condition control unit 74 determines, on the basis of the apparatus information database 64 stored in the storing unit 53, whether or not the image forming apparatus 40 to be selected satisfies the condition that a different image forming apparatus 40 that is installed at the same place as the image forming apparatus 40 to be selected is selected or the condition that no other image forming apparatus 40 is installed at the same place as the image forming apparatus 40 to be selected. In the case where the image forming apparatus 40 to be selected satisfies one of the above-mentioned conditions, the second condition control unit 74 selects the image forming apparatus 40 having the next highest priority level among the image forming apparatuses 40 that are not compulsorily caused to enter the energy-saving mode, without selecting the image forming apparatus 40 to be selected.

Furthermore, in the case where one image forming apparatus 40 is selected at every place where the image forming apparatuses 40 are installed or in the case where only one image forming apparatus 40 is installed at every place where the image forming apparatuses 40 are installed, the second condition control unit 74 selects the image forming apparatus 40 having the highest priority level among the image forming apparatuses 40 that are not compulsorily caused to enter the energy-saving mode, as in the embodiment described above. However, even in this case, when the image forming apparatus 40 to be selected satisfies the condition that all the other image forming apparatuses 40 installed at the same place as the image forming apparatus 40 to be selected are selected or the condition that no other image forming apparatus 40 is installed at the same place as the image forming apparatus 40 to be selected, the second condition control unit 74 selects the image forming apparatus 40 having the next highest priority level among the image forming apparatuses 40 that are not compulsorily caused to enter the energy-saving mode, without selecting the image forming apparatus 40 to be selected. Furthermore, in the case where only one image forming apparatus 40 is unselected at every place where the image forming apparatuses 40 are installed or in the case where only one image forming apparatus 40 is installed at every place where the image forming apparatuses 40 are installed, the second condition control unit 74 selects the image forming apparatus 40 having the highest priority level among the image forming apparatuses 40 that are not compulsorily caused to enter the energy-saving mode, as in the embodiment described above.

For selection of an image forming apparatus 40 in step S34, the third condition control unit 75 determines, on the basis of the apparatus information database 64 stored in the storing unit 53, whether or not the image forming apparatus 40 to be selected satisfies the condition that a different image forming apparatus 40 that is installed at the same place as the image forming apparatus 40 to be selected is selected. In the case where the image forming apparatus 40 to be selected satisfies the above-described condition, the third condition control unit 75 selects the image forming apparatus 40 having the next lowest priority level among the image forming apparatuses 40 that are not prohibited from entering the energy-saving mode, without selecting the image forming apparatus 40 to be selected. Furthermore, in the case where one image forming apparatus 40 is selected at every place where the image forming apparatuses 40 are installed, the third condition control unit 75 selects the image forming apparatus 40 having the lowest priority level among the image forming apparatuses 40 that are not prohibited from entering the energy-saving mode, as in the embodiment described above.

According to this modification, since a situation in which all the image forming apparatuses 40 that are installed at the same place enter the energy-saving mode is suppressed, degradation in user-friendliness is suppressed as far as possible.

(5) Fifth Modification

The priority determining unit 72 may categorize the image forming apparatuses 40 into groups and may determine priority for each of the groups. For example, the priority determining unit 72 may categorize the image forming apparatuses 40 installed at the same place as a group and may assign the same priority level for the image forming apparatus 40 belonging to the group. In this case, the priority level 67 of individual places where the image forming apparatuses 40 are installed is stored in advance in the storing unit 53. FIG. 18 illustrates an example of the priority level 67 of individual places where the image forming apparatuses 40 are installed. The priority determining unit 72 determines the priority level "1" for a group of image forming apparatuses 40 that are installed at a place "1F-1", determines the priority level "2" for a group of image forming apparatuses 40 that are installed at a place "2F-1", determines the priority level "3" for a group of image forming apparatuses 40 that are installed at a place "1F-2", determines the priority level "4" for a group of image forming apparatuses 40 that are installed at a place "2F-3", and determines the priority level "5" for a group of image forming apparatuses 40 installed at a place "2F-4", on the basis of the priority level 67 of the individual places where the image forming apparatuses 40 are installed.

In this case, in step S14, the first condition control unit 73 selects target image forming apparatuses 40 of the group having a high priority level. In step S24, the second condition control unit 74 selects an image forming apparatus 40 of the group having the highest priority level among the image forming apparatuses 40 that are not compulsorily caused to enter the energy-saving mode. In step S34, the third condition control unit 75 selects an image forming apparatus 40 of the group having the lowest priority level among the image forming apparatuses 40 that are not prohibited from entering the energy-saving mode.

Furthermore, in this modification, the priority determining unit 72 may categorize image forming apparatuses 40 into groups in accordance with the condition as to whether a color image or a monochrome image is to be formed or the condition regarding the size of the power consumption, and may determine the priority level for each of the groups.

(6) Sixth Modification

In the embodiment described above, the image forming apparatus 40 has a normal operation mode and an energy-saving mode. However, the image forming apparatus 40 may have two-level energy-saving modes with different power consumptions. Here, a first energy-saving mode defines an energy-saving mode in which the reduction in the power consumption is smaller, and a second energy-saving mode defines an energy-saving mode in which the reduction in the power consumption is larger. In this case, in step S15, the first condition control unit 73 may shorten a transition period for transition from the normal operation mode to the first energy-saving mode or the second energy-saving mode or shorten a transition period for transition from the first energy-saving mode to the second energy-saving mode. In step S25, the second condition control unit 74 may compulsorily cause the image forming apparatuses 40 to change from the normal operation mode into the first energy-saving mode or the second energy-saving mode or may compulsorily cause the image forming apparatuses 40 to change from the first energy-saving mode into the second energy-saving mode. In step S35, the third condition control unit 75 may prohibit the image forming apparatuses 40 from changing from the first energy-saving mode or the second energy-saving mode to the normal operation mode or may prohibit the image forming apparatuses 40 from changing from the second energy-saving mode into the first energy-saving mode.

(7) Seventh Modification

In the embodiment described above, the power calculator 20 only calculates current. However, the power calculator 20 may calculate power consumption as well as power. In this case, like the power computing unit 71 described above, the power calculator 20 computes power consumption on the basis of the calculated current and transmits the computed power consumption to the management apparatus 50. In this case, the management apparatus 50 may not include the power computing unit 71.

(8) Eighth Modification

The configuration of the power control system 1 described in the foregoing embodiment is merely an exemplification and the present invention is not limited to this. For example, the power calculator 20 may calculate the current supplied from equipment that is different from the switchboard 10 and that supplies power to plural apparatuses including the image forming apparatuses 40.

(9) Ninth Modification

The management apparatus 50 may not include all the first condition control unit 73, second condition control unit 74, and the third condition control unit 75. For example, the management apparatus 50 may include one or two of the first condition control unit 73, the second condition control unit 74, and the third condition control unit 75.

(10) Tenth Modification

A program executed by the CPU 51 may be recorded in a recording medium such as a magnetic tape, a magnetic disk, a flexible disk, an optical disk, a magneto-optical disk, or a memory, be supplied, and be installed into the image forming apparatuses 40. Furthermore, the program may be downloaded into the image forming apparatuses 40 via a communication line such as the Internet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A power control system comprising:

an image forming apparatus that operates using power, that forms an image corresponding to image information in a first operation mode, and that enters a second operation mode in which power consumption is smaller than the first operation mode in response to the image forming apparatus satisfying a specific transition condition;

a power calculating unit that calculates power supplied from a power supplying unit; and a condition controller that controls the specific transition condition for the image forming apparatus in accordance with the power calculated by the power calculating unit, wherein the specific transition condition is that an operation or input of the image information is not performed within a specific transition period in the first operation mode, wherein the power calculating unit calculates power supplied from the power supplying unit to a plurality of apparatuses including the image forming apparatus, wherein the condition controller controls the specific transition condition for the image forming apparatus in accordance with a result of the calculation by the power calculating unit, wherein the condition controller includes a first condition controller that shortens the transition period in response to the power calculated by the power calculating unit exceeding a first threshold, and wherein the condition controller includes a second condition controller that causes the image forming apparatus to enter the second operation mode without the specific transition condition being satisfied in response to the power calculated by the power calculating unit exceeding a second threshold.

2. The power control system according to claim 1, further comprising a priority determining unit, wherein the image forming apparatus is one from among a plurality of image forming apparatuses in the power control system, wherein the priority determining unit determines priority level for the plurality of image forming apparatuses, and wherein the second condition controller selects, one by one, the plurality of image forming apparatuses in accordance with the priority level determined by the priority determining unit until the power calculated by the power calculating unit reaches the second threshold or less, and causes the selected image forming apparatuses to enter the second operation mode.

3. The power control system according to claim 1, wherein the image forming apparatus is one from among a plurality of image forming apparatuses in the power control system, wherein in response to the second condition controller causing an image forming apparatus to enter the second operation mode, the second condition controller prohibits the image forming apparatus from returning to the first operation mode, and wherein in response to the image forming apparatus being caused to enter the second operation mode by the second condition controller, upon receiving the image information, the image forming apparatus transfers the received image information to a different image forming apparatus and requests the different image forming apparatus to form an image.

4. A power control system comprising:

an image forming apparatus that operates using power, that forms an image corresponding to image information in a first operation mode, and that enters a second operation mode in which power consumption is smaller than the first operation mode in response to the image forming apparatus satisfying a specific transition condition;

a power calculating unit that calculates power supplied from a power supplying unit; and a condition controller that controls the specific transition condition for the image forming apparatus in accordance with the power calculated by the power calculating unit, wherein the condition controller includes a second condition controller that causes the image forming apparatus to enter the second operation mode without the specific transition condition being satisfied in response to the power calculated by the power calculating unit exceeding a second threshold.

5. The power control system according to claim 4, wherein the image forming apparatus is one from among a plurality of image forming apparatuses in the power control system, wherein in response to the second condition controller causing an image forming apparatus to enter the second operation mode, the second condition controller prohibits the image forming apparatus from returning to the first operation mode, and wherein in response to the image forming apparatus being caused to enter the second operation mode by the second condition controller, upon receiving the image information, the image forming apparatus transfers the received image information to a different image forming apparatus and requests the different image forming apparatus to form an image.

6. The power control system according to claim 4, further comprising a priority determining unit, wherein the image forming apparatus is one from among a plurality of image forming apparatuses in the power control system, wherein the priority determining unit determines priority level for the plurality of image forming apparatuses, and wherein the second condition controller selects, one by one, the plurality of image forming apparatuses in accordance with the priority level determined by the priority determining unit until the power calculated by the power calculating unit reaches the second threshold or less, and causes the selected image forming apparatuses to enter the second operation mode.

7. A power control system comprising:

an image forming apparatus that operates using power, that forms an image corresponding to image information in a first operation mode, and that enters a second operation mode in which power consumption is smaller than the first operation mode in response to the image forming apparatus satisfying a specific transition condition;

a power calculating unit that calculates power supplied from a power supplying unit; and a condition controller that controls the specific transition condition for the image forming apparatus in accordance with the power calculated by the power calculating unit, wherein the condition controller includes a third condition controller that prohibits the image forming apparatus from entering the second operation mode in response to the power calculated by the power calculating unit being below a third threshold.

8. The power control system according to claim 7, further comprising a priority determining unit, wherein the image forming apparatus is one from among a plurality of image forming apparatuses in the power control system, wherein the priority determining unit determines priority level for the plurality of image forming apparatus, and wherein as long as the power calculated by the power calculating unit is below the third threshold, the third condition controller selects, one by one, the plurality of image forming apparatuses in accordance with the priority level determined by the priority determining unit, and prohibits the selected image forming apparatuses from entering the second operation mode.

9. A power control system comprising:

an image forming apparatus that operates using power, that forms an image corresponding to image information in a first operation mode, and that enters a second operation mode in which power consumption is smaller than the first operation mode in response to the image forming apparatus satisfying a specific transition condition;

a power calculating unit that calculates power supplied from a power supplying unit; and a condition controller that controls the specific transition condition for the image forming apparatus in accordance with the power calculated by the power calculating unit, wherein the specific transition condition is that an operation or input of the image information is not performed within a specific transition period in the first operation mode;

wherein the power calculating unit calculates power supplied from the power supplying unit to a plurality of apparatuses including the image forming apparatus, wherein the condition controller controls the specific transition condition for the image forming apparatus in accordance with a result of the calculation by the power calculating unit, wherein the condition controller includes a first condition controller that shortens the transition period in response to the power calculated by the power calculating unit exceeding a first threshold, and wherein the condition controller includes a third condition controller that prohibits the image forming apparatus from entering the second operation mode in response to the power calculated by the power calculating unit being below a third threshold.

10. The power control system according to claim 9, further comprising a priority determining unit, wherein the image forming apparatus is one from among a plurality of image forming apparatuses in the power control system, wherein the priority determining unit determines priority level for the plurality of image forming apparatus, and wherein as long as the power calculated by the power calculating unit is below the third threshold, the third condition controller selects, one by one, the plurality of image forming apparatuses in accordance with the priority level determined by the priority determining unit, and prohibits the selected image forming apparatuses from entering the second operation mode.

11. A power control system comprising:

one or more image forming apparatuses that are each multimodal;

a power calculating unit that calculates an amount of power supplied to the one or more image forming apparatuses; and a condition controller that controls at least one of the one or more image forming apparatuses to enter a mode for reducing power consumption in response to the calculated amount of power supplied exceeding a threshold, wherein there is a plurality of the image forming apparatuses and, in response to the calculated amount of power supplied exceeding the threshold, the condition controller controls the plurality of image forming apparatuses to enter the mode for reducing power consumption on a one-by-one basis until the calculated amount of power supplied is below the threshold, and wherein the threshold is a first threshold and, in response to the calculated amount of power supplied exceeding a second threshold that is greater than the first threshold, i) the condition controller controls the plurality of image forming apparatuses to enter the mode for reducing power consumption on a one-by-one basis, and ii) each image forming apparatus that enters the mode for reducing power consumption remains in the mode for reducing power consumption after the calculated amount of power supplied is below the second threshold.

12. A power control system comprising:

one or more image forming apparatuses that are each multimodal;

a power calculating unit that calculates an amount of power supplied to the one of more image forming apparatuses; and a condition controller that controls at least one of the one or more image forming apparatuses to enter a mode for reducing power consumption in response to the calculated amount of power supplied exceeding a threshold, wherein there is a plurality of the image forming apparatuses and, in response to the calculated amount of power supplied exceeding the threshold, the condition controller controls the plurality of image forming apparatuses to enter the mode for reducing power consumption on a one-by-one basis until the calculated amount of power supplied is below the threshold, and wherein at least one of the plurality of the image forming apparatuses does not enter the mode for reducing the power consumption.

13. A power control system comprising:

one or more image forming apparatuses that are each multimodal;

a power calculating unit that calculates an amount of power supplied to the one or more image forming apparatuses; and a condition controller that controls at least one of the one or more image forming apparatuses to enter a mode for reducing power consumption in response to the calculated amount of power supplied exceeding a threshold, wherein there is a plurality of the image forming apparatuses and, in response to the calculated amount of power supplied exceeding the threshold, the condition controller controls the plurality of image forming apparatuses to enter the mode for reducing power consumption on a one-b one basis until the calculated amount lied is below the threshold, and wherein the condition controller prioritizes the plurality of image forming apparatuses based on at least one priority condition of respective image forming apparatuses in order to determine an order for controlling the plurality of image forming apparatuses to enter the mode for reducing power consumption on the one-by-one basis.

14. The power control system according to claim 13, wherein the at least one priority condition is selected from among whether the image forming apparatus prints in color, power consumption of the image forming apparatus, a number of clients of the image forming apparatus, a number of printed pages of the image forming apparatus, and a location of the image forming apparatus.

* * * * *